US005419542A

United States Patent [19]

Yamada et al.

[11] Patent Number: 5,419,542

[45] Date of Patent: May 30, 1995

[54] AUTOMATIC DOCUMENT FEEDER

[75] Inventors: Yasushi Yamada, Hachioji; Tadashi Uematsu; Shigeo Inaba, both of Oizumi; Hiroyuki Hara, Kamifukuoka, all of Japan

[73] Assignee: Konica Corporation, Tokyo, Japan

[21] Appl. No.: 101,715

[22] Filed: Aug. 2, 1993

[30] Foreign Application Priority Data

| | | | |
|---|---|---|---|
| Aug. 5, 1992 | [JP] | Japan | 4-209199 |
| Sep. 28, 1992 | [JP] | Japan | 4-258474 |
| Oct. 7, 1992 | [JP] | Japan | 4-268806 |

[51] Int. Cl.[6] ..... B65H 5/22

[52] U.S. Cl. ..... 271/3.1; 271/127; 271/212; 271/254; 271/270

[58] Field of Search ..... 271/3.1, 34, 127, 212, 271/254, 270, 202

[56] References Cited

U.S. PATENT DOCUMENTS

| | | | |
|---|---|---|---|
| 4,685,664 | 8/1987 | Petersdorf | 271/250 |
| 4,703,923 | 11/1987 | Anderson et al. | 271/3.1 |
| 5,022,641 | 6/1991 | Okada . | |
| 5,033,728 | 7/1991 | Miura et al. . | |
| 5,092,576 | 3/1992 | Takahashi et al. | 271/3.1 |
| 5,183,240 | 2/1993 | Morooka et al. | 271/3.1 |
| 5,280,896 | 1/1994 | Yamada | 271/3.1 |

FOREIGN PATENT DOCUMENTS

| | | | |
|---|---|---|---|
| 0477946 | 4/1992 | European Pat. Off. . | |
| 0478336 | 4/1992 | European Pat. Off. . | |
| 4217568 | 8/1992 | Japan | 271/3.1 |

OTHER PUBLICATIONS

Patent Abstracts of Japan vol. 15, No. 481, 6 Dec. 1991; & JP-A-03 205 273 Abstract.

*Primary Examiner*—H. Grant Skaggs

*Attorney, Agent, or Firm*—Frishauf, Holtz, Goodman & Woodward

[57] ABSTRACT

A sheet feeding apparatus includes an endless belt which is postioned to be adjacent to a rear part of a sheet stand on which trailing edges of a pile of sheets are loaded. The endless belt includes a holding member to hold a leading edge of a sheet that is being returned to the sheet stand so that the endless belt conveys the sheet together with the holding member and inserts the sheet being returned to the sheet stand under the pile of sheets. A single stopper is provided on the sheet stand to align the sheets of the pile as well as the sheets inserted under the pile.

12 Claims, 19 Drawing Sheets

FIG. 10 (C) RDH

FIG. 10 (D) R-RDH

AUTOMATIC DOCUMENT FEEDER

BACKGROUND OF THE INVENTION

The present invention relates to improvements in an automatic document feeder used for a recording device or an image reading device of an electrophotographic copier, and more particularly relates to improvements in a circulation type automatic document feeder having a document feeding mode (RDH) in which one-sided or two-sided documents stacked on a document stack section are separated from the document stack one by one and fed to an image reading section and then the document is returned to the document stack section so that it can be repeatedly fed, and also having a two-sided document reversal feeding mode (R-RDH).

An automatic document feeder (ADF) that can efficiently and automatically feed a document on which an image is recorded, has already been provided to a recording device of an electrophotographic copier or a recorded image reading apparatus.

An automatic document feeder (RADF) having a reversal function by which a document is reversed, is put into practical use as a copier by which the images on a two-sided document are copied onto one side or both sides of a recording paper and as an image reading apparatus by which the images are read.

Also, a circulation type automatic document feeder (RDH) has been proposed in which the documents stacked on a document stack section are separated one by one and automatically fed onto a platen glass and the document exposed on the platen glass is returned to the document stack section so that the document can be repeatedly processed.

By this circulation type automatic document feeder (RDH), a copy is made when a document is circulated once, so that the document is circulated by the number of required copies.

Moreover, a circulation type automatic document feeder (R-RDH) has been also provided in which a document reversal mechanism is added to the RDH described above (disclosed in Japanese Patent Application No. 20228/1988).

By these circulation type automatic document feeder (RDH and R-RDH), which will be referred to as RDH hereinafter, it is possible to conduct a high speed continuous copying operation and to quickly collate copied recording papers. Moreover, when the circulation type automatic document feeder (RDH) is combined with a finisher device by which stapling and punching operations are conducted on the recording papers, the overall recording operation can be automatically performed.

The aforementioned RDH device is of a bottom-feed-top-return type in which: a plurality of documents are stacked on the document stack section under the condition that the front surfaces of the documents are set upward; and the lowermost document is separated from the document stack one by one and conveyed to the processing section (the platen glass surface).

In the bottom-feed-top-return type apparatus described above, when a document is sent out from the document stack, the front surface of a document and the back surface of another document are rubbed with each other, so that the image on the rubbed document is damaged and further the front and back surfaces of a document are stained. Especially when a document is written with a pencil, the document is remarkably stained.

In order to solve the above problems, a top-feed-bottom-restack type RDH apparatus has been disclosed in Japanese Patent Publication No. 37536/1981. In this apparatus, a processed sheet is inserted under the sheet stack with a cyclic operation type stack lifting means.

The following problems may be encountered in the top-feed-bottom-restack type RDH.

(1) Structure of the cyclic operation type lifting means is complicated.

(2) In the case where an end portion of a sheet to be inserted under the stack is curled, there is a high possibility that the end portion is caught by the cyclic operation type stack lifting means.

(3) When a sheet is returned at high speed, the operation of a document feeder becomes complicated, so that the operation becomes unstable.

(4) Each time a sheet is returned, the stack lifting means is moved upward and downward, so that noises are caused.

(5) It is difficult to adjust the apparatus when the sheet size is changed.

In order to overcome the above disadvantages, the invention disclosed in Japanese Patent Publication Open to Public Inspection No. 403220/1990 is constituted in the following manner: The circulation type top-feed-bottom-return automatic document feeder includes an upper suction fan means, an upper feeding belt type document feeding means, and a lower document return rotation means composed of a plurality of thin belts.

However, in the automatic document feeder constituted in the aforementioned manner, the following problems may be encountered, so that improvements are required.

(1) Noises are caused by the suction fan means, and its manufacturing cost is high.

(2) In the structure in which a plurality of thin belts are disposed, a document conveyed on the belts is not uniformly contacted with the belts because there are gaps between the belts, so that the document surface is formed into a wave-shape, and the protruded portions at the leading end of the document on the belts collide with the trailing end of an upper document. As a result, documents are jammed.

In order to overcome the aforementioned disadvantages, the first object of the present invention is to provide a circulation type automatic document feeder of an upper-feed-bottom-insertion system that can be stably operated even when documents are fed at high speed and further the document feeder can handle various sizes of documents.

In addition to the aforementioned apparatus, the sheet accommodation and supply apparatus disclosed in Japanese Patent Publication Open to Public Inspection No. 205273/1991 is constituted in the following manner: In an RDH device, a return document is reversed and inserted into the bottom of a document bundle on the downstream side of document feed; and a vertical press member is provided in the upper rear end position of the document bundle.

In the aforementioned automatic document feeder having the RDH mode and R-RDH function, it is necessary to provide a separation means to separate a document conveyed out from the image reading means and stacked again on the document stack section, from a document bundle previously stacked on the document stack section.

In the conventional bottom-feed-top-return type RDH device, the separation means is composed of a simple lever lightly coming into contact with the upper surface of a document bundle. However, in the RDH device of the top-feed-bottom-return system, it is necessary to provide a movable separation means below the lowermost sheet of the document bundle. Accordingly, there is a possibility that the separation means interferes with a document to be conveyed by the document feed means. Especially in the RDH device operated at high speed, it is necessary to stabilize the operation of the document separation means.

The present invention overcomes the disadvantages of the conventional automatic document feeder. The second object of the present invention is to provide an automatic document feeder having an RDH device of the top-feed-bottom-return system in which a document separation means is provided that can be positively advanced and withdrawn below the lowermost document to be circulated.

SUMMARY OF THE INVENTION

In order to accomplish the first object of the present invention, the circulation type automatic document feeder of the top-feed-bottom-return system of the present invention comprises: a document stack section capable of stacking a plurality of documents; a paper feeding means that separates an uppermost document one by one from a plurality of documents stacked on the document stack section and feeds the separated document to a reading section; a conveyance means disposed downstream of the paper feeding means, the conveyance means conveying a document while the document is being pressed by the conveyance means; and a paper discharging means disposed downstream of the reading means, the paper discharging means returning a document conveyed by the conveyance means to the document stack section so that the discharged document can be inserted below the lowermost document of the document stack on the document stack section, wherein the leading end of the document discharged from the document discharging means is held so as to be conveyed, the document is inserted below the lowermost document of the document stack on the document stack section, and the conveyed documents are successively stacked on the surface of a paper conveyance belt by a rotation means composed of the paper conveyance belt that can be rotated in the paper feeding direction by a drive means.

Also, the automatic document feeder of the present invention comprises: a stopper member disposed under the paper feeding means, the stopper member aligning the leading end portions of the plurality of documents; a movable press means provided upstream of the stopper member, the movable press means pushing up the leading end portions of the document stack on the document stack section so as to press the leading end portions against the paper feeding means; and a rotation means provided upstream of the movable press means, the rotation means holding the leading end of a document discharged from the paper discharging means, the rotation means conveying the document so as to insert the document below the lowermost document of the document stack on the document stack section, the rotation means including a movable paper feeding belt that can be rotated in the paper feeding direction by a drive means, wherein the document stack is stacked on each of the stacking surfaces of the movable press means and the rotation means.

Further, the automatic document feeder of the present invention comprises: a stopper member disposed under the paper feeding means, the stopper member aligning the leading end portions of the plurality of documents; a movable press means provided upstream of the stopper member, the movable press means pushing up the leading end portions of the document stack on the document stack section so as to press the leading end portions against the paper feeding means; a rotation means provided upstream of the movable press means, the rotation means holding the leading end of a document discharged from the paper discharging means, the rotation means conveying the document so as to insert the document below the lowermost document of the document stack on the document stack section, the rotation means including a movable paper feeding belt that can be rotated in the paper feeding direction by a drive means, and a copy number classifying means provided on a fixed supporting plate, the copy number classifying means classifying the number of copies to be stacked on the paper feeding belt and that of copies to be circulated and fed to the bottom portion of the stack.

In order to accomplish the first object of the present invention, the circulation type automatic document feeder of the top-feed-bottom-return system of the present invention comprises: a document stack section composed of a paper feeding belt on which at least one pair of documents can be loaded and the loaded documents are moved to a document feeding position by the feeding belt; a paper feeding means that separates an uppermost document one by one from a plurality of documents stacked on the document stack section and feeds the separated document to a reading section; a conveyance means disposed downstream of the paper feeding means, the conveyance means conveying a document on the image reading means; and a paper discharging means disposed downstream of the reading means, the paper discharging means returning a document conveyed by the conveyance means to the document stack section so that the discharged document can be inserted below the lowermost document of the document stack on the document stack section, wherein a holding section capable of holding the leading end of a document is attached to one portion of the feeding belt, and the friction coefficient of at least a portion of the feeding belt of a position where the holding section is attached, to a position where the trailing end of the document is contacted, is higher than that of other portions.

In order to accomplish the second object of the present invention, the circulation type automatic document feeder of the top-feed-bottom-return system of the present invention comprises: a document stack section capable of stacking a plurality of documents; a paper feeding means that separates an uppermost document one by one from a plurality of documents stacked on the document stack section and feeds the separated document to a reading section; a conveyance means disposed downstream of the paper feeding means, the conveyance means conveying a document while the document is being pressed by the conveyance means; a paper discharging means disposed downstream of the reading means, the paper discharging means returning a document conveyed by the conveyance means to the document stack section; and a separation means to separate a document sent from the document stack section, from a document returned to the document stack section from the discharging means, the separation means being disposed close to the side edge portion on the document side, wherein the end portion of a separation lever can be moved through the first motion in which the separation lever withdraws from the first position on the side edge upper portion of the stacked document to the second position outside of the side edge of the document, the second motion in which the separation lever advances from the second position to the third position of the bottom of the document stack on the document stack section, and the third motion in which the document stack is partially pushed upward.

The circulation type automatic document feeder of the present invention comprises: a separation means having a separation lever to separate a document fed from the document stack section, from a document returned to the document stack section from the discharging means; and a pushing means to push up the end portion of the separation lever, wherein both means are disposed close to the side edge portion of the document, and the side edge of the document is raised to a predetermined height when the end portion of the separation lever advanced into the bottom portion of the document stack pushes the stack by the drive force of the pushing means.

Also, in order to accomplish the second object of the present invention, the circulation type automatic document feeder of the top-feed-bottom-return system of the present invention comprises: a document stack section on which at least one pair of documents can be loaded; a paper feeding means that separates an uppermost document one by one from a plurality of documents stacked on the document stack section and feeds the separated document to a reading section; a conveyance means disposed downstream of the paper feeding means, the conveyance means conveying a document on the image reading means; a paper discharging means disposed downstream of the reading means, the paper discharging means returning a document conveyed by the conveyance means to the document stack section; and a paper feeding belt that holds the leading end of a document returned to the document stack section and conveys the document in the paper feeding direction so that the document can be inserted below the lowermost document; and a separation means disposed close to the side edge portion of the feeding belt, the separation means being inserted between a document of the document stack to be fed last and a document of the pair of documents to be returned first to the document stack section from the discharging means, the separation means including a separation lever, wherein a cutout portion is formed close to the side edge portion of the feeding belt so that the separation lever can not be blocked while it is moved.

DETAILED DESCRIPTION OF THE PREFERRED EMBODIMENTS

With reference to the attached drawings, examples of the present invention will now be described as follows.

Figure 1:
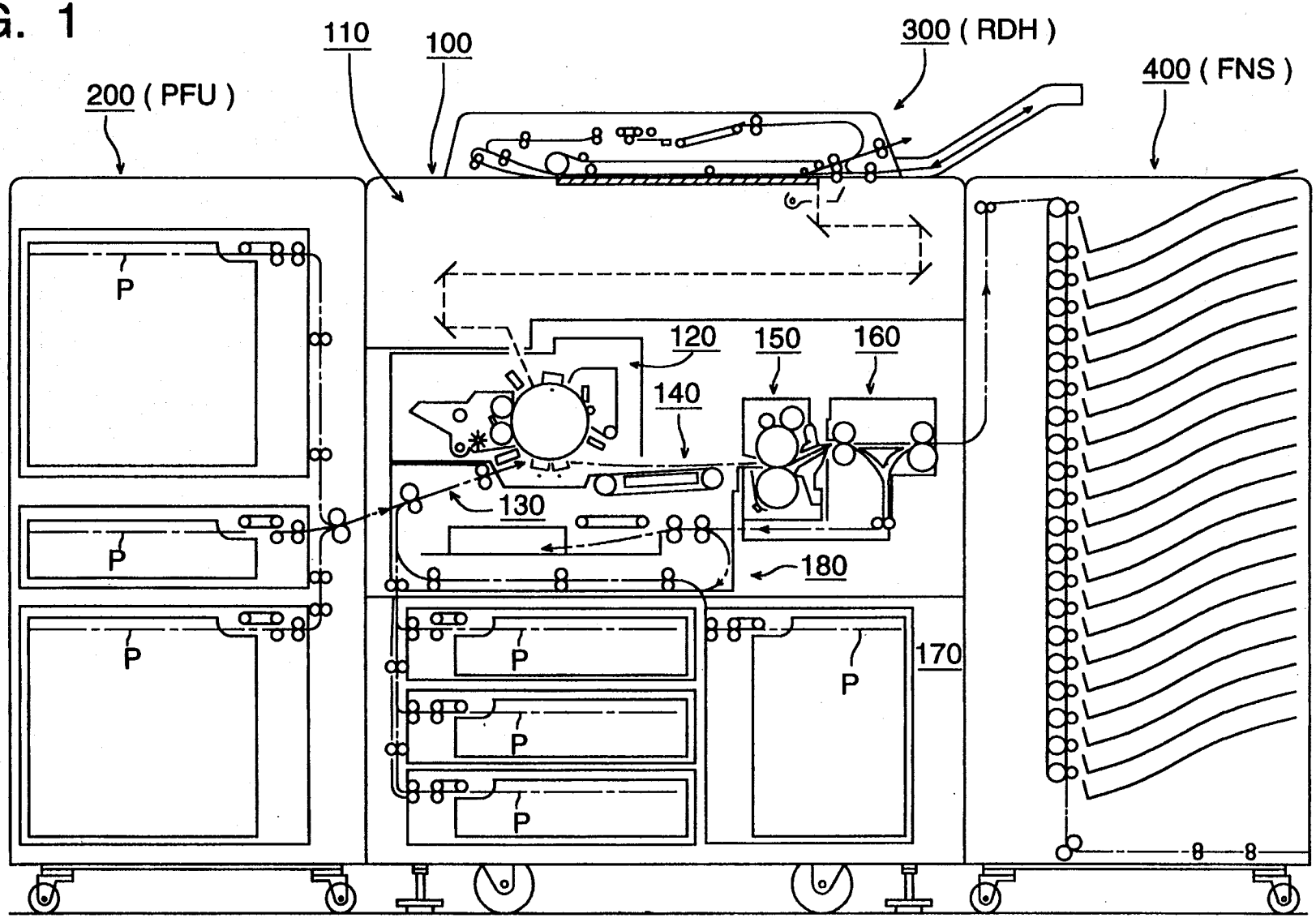
FIG. 1 is an overall arrangement view of a copier to which the automatic document feeder of the present invention is applied.

FIG. 1 is an overall arrangement view of a copier provided with an automatic document feeder, wherein numeral 100 is a copier body, numeral 200 is a paper feeding unit, numeral 300 is a circulation type automatic document feeder (RDH device), and numeral 400 is a copy paper after-processing device (a finisher, that is, a sorter having a stapler, which will be referred to as an FNS device, hereinafter).

The copier body 100 includes a scanning exposure section 110, image forming section 120, paper feeding section 130, conveyance section 140, fixing section 150, discharged paper switching section 160, a plurality of paper feeding cassettes 170, and copy paper refeeding device (ADU device) 180 for two-sided copying.

In the drawing, a one-dotted chain line shows a conveyance passage for copy papers P. As illustrated in the drawing, the conveyance passage is composed of a main route and a circulation route. According to the main route, an image is formed on a copy paper P accommodated in the paper feed cassette 170 provided in the lower portion of the copier body 100 or accommodated in the paper feed unit (PFU) 200, and then the copy paper P passes through the conveyance section 140, fixing section 150 and discharged paper switching section 160 and is accommodated in the FSN device 400. According to the circulation route, the copy paper P branches from the main route by the action of the discharged paper switching section 160, and is temporarily stored in the ADU device 180 and then conveyed to the paper feed section 130 of the copier body 100 again.

Figure 2:
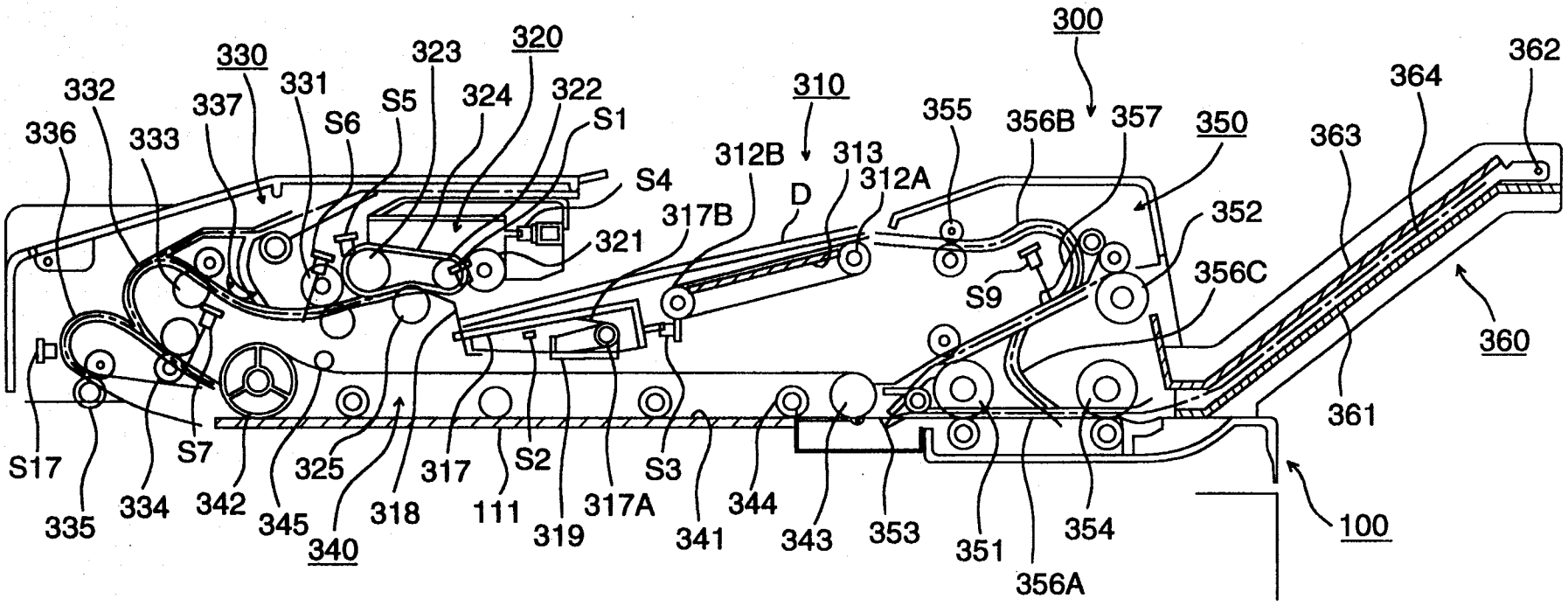
FIG. 2 is a sectional view of the aforementioned automatic document feeder.

FIG. 2 is a sectional view of an automatic document feeder 300 attached to the upper portion of the copier body 100. The automatic document feeder 300 to which the present invention can be applied is provided with the functions of circulation types of RDH and R-RDH devices in which a plurality of documents (one-sided or two-sided documents) are conveyed to the exposure section on the platen glass 111 of the copier body 100 from the document stack section 310 and then conveyed again onto the document stack section 310. Also, the automatic document feeder 300 to which the present invention can be applied is provided with the functions of the ADF and R-ADF devices.

The automatic document feeder 300 includes the document stack section 310, feed section 320, intermediate conveyance section 330, conveyance section 340 and paper discharging and reversal section 350.

When a document stack D is set on the document stack section 310, the existence of documents is detected by a document set detection sensor S1, and ADF mode is displayed on the control panel according to the result of the detection. When the document stack D is set at a predetermined position, the document size (B5 to A3) is detected by a document size sensor S2 and inputted into the control section of the copier body 100.

At the end of the document stack section 310 on the downstream side of document flow, a movable pushing plate 317 is pivotally provided around an oscillation shaft 317A. A drive plate 319 is secured to the oscillation shaft 317A with screws. Accordingly, the drive plate 319 can be oscillated integrally with the oscillation shaft 317A. A resilient deformation member (for example, a torsion spring) 317B is wound around the oscillation shaft 317A, so that the drive plate 319 can be pushed by both ends of the oscillation shaft 317A, and the movable pushing plate 317 can be pushed by the central portion of the oscillation shaft 317A.

An actuator section attached to the drive plate 319 turns on and off the optical path of the pressure home position sensor S3 secured to the fixed bottom plate, so that the home position of the drive plate 319 is detected.

Figure 3:
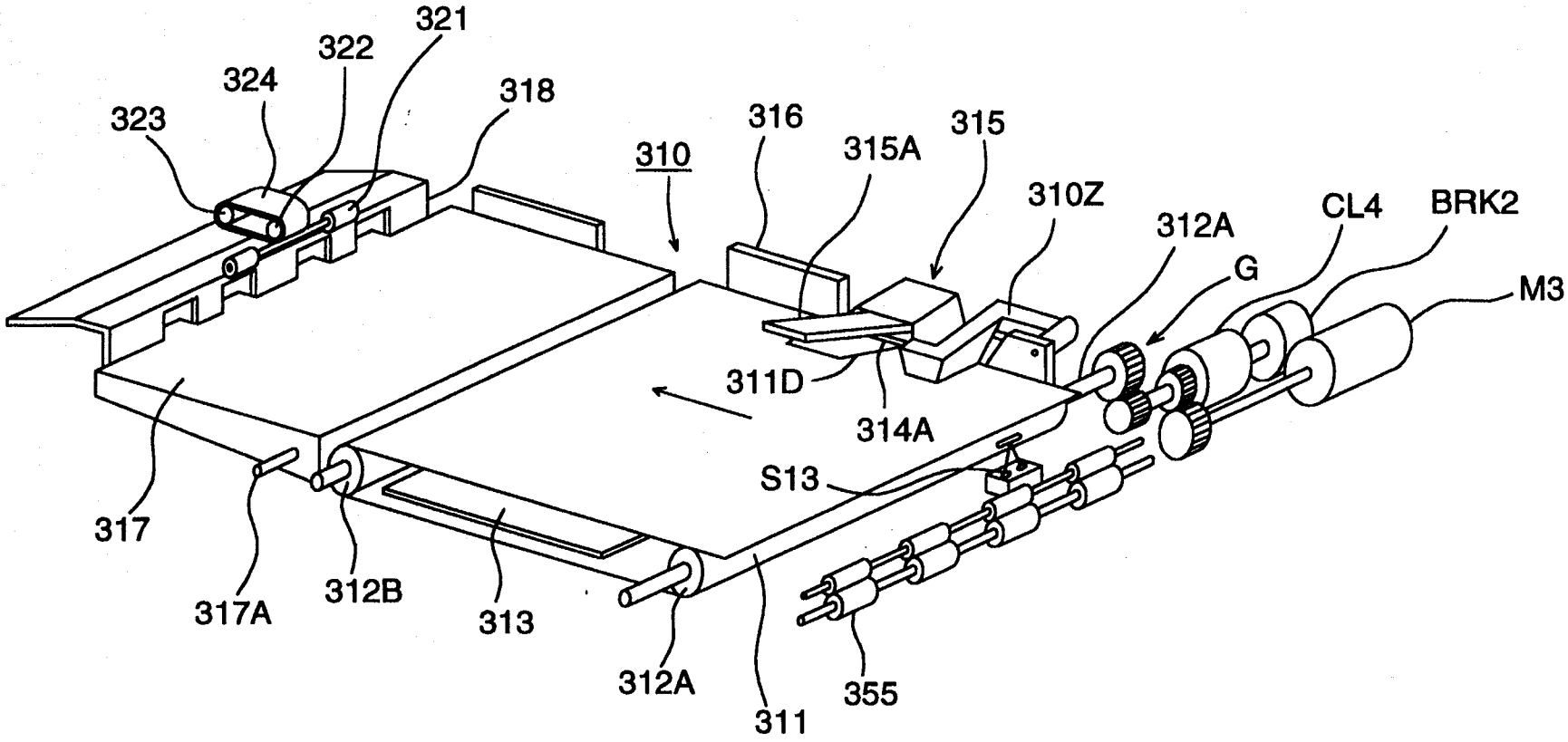
FIG. 3 is a perspective view showing the primary portion of a document stack section.

FIG. 3 is a perspective view of the primary portion of the document stack section 310. Document D is loaded and supported by the feed belt 311 that is a rotatable wide endless belt and wound around the drive roller 312A and the idle roller 312B.

FIG. 4A is a perspective view of the feed belt 311, FIG. 4B is a sectional view of the feed belt 311 of a preferable example, and FIG. 4C is a partially enlarged sectional view of the feed belt shown in FIG. 4B. One end portion of the feed belt 311 is joined by a joint section 311A so that the feed belt 311 is formed into a loop, and the other end portion of the feed belt 311 is extended outside of the joint section 311A so that the extended portion is formed into a protruding gripper section 311B. The feed belt 311 is a cloth belt coated with resin, or a belt made of a polyethylene terephthalate (PET) film. The inner surface of the gripper section 311B of the feed belt 311 and a portion of the outer surface of the feed belt 311 (a portion between "A" and "B" illustrated in FIGS. 4A and 4B) are made rough so that the friction coefficients of the rough surfaces are higher than those of other surfaces, and the friction coefficient of other portion of the outer surface (a portion between "B" and "C" in FIGS. 4A and 4B) is low so that the surface is slippery. In this case, a portion of the feed belt 311A between "A" and "B" may be partially made to be a rough surface. For example, a portion of the outer surface of the feed belt 311 (a portion between "A" and "B") may be partially made to a rough surface composed of a plurality of small protrusions 311E, and further the surfaces of the small protrusions 311E may be made rough so that the friction coefficient is high. In this case, numeral 311C is a hole used for detection. When a reflection type sensor S13 for home position detection detects the hole 311C, the home position of the feed belt 311 can be detected, and the stop position of the gripper section 311B of the feed belt 311 can be controlled in accordance with the result of detection.

Instead of the hole formed on the feed belt 311, a reflection type mark may be provided on the circumferential surface of the feed belt 311. Alternatively, the feed belt 311 may be made of a white belt having a through hole 311C, and the reflection type sensor PS1 may detect the through hole 311C.

As shown in FIG. 3, an electromagnetic brake BRK2 and an electromagnetic clutch CL4, which are connected with a paper discharging drive motor M3, are provided at the end of the. rotational shaft of the drive roller 312A. A fixed plate 313 is secured inside the feed belt 311 between the drive roller 312A and the idle roller 312B. Due to the fixed plate 313, document stack D on the feed belt 311 can be supported on a plane.

Numeral 315 is a separation means that separates a document stack stacked on the feed belt 311 from a document stack inserted below the lowermost document of the document stack, wherein the inserted documents have been circulated and conveyed after image reading processing. A separation lever 315A of the separation means 315 is pushed by a spring, and operated by the action of solenoids SL3 and SL4 so that it can be moved vertically and further in a direction perpendicular to the paper forward direction and moreover it can be lowered diagonally (shown in FIGS. 5 and 6).

Numeral 311D is a cutout portion formed on the side of the feed belt 311 so that the separation lever 315A can be withdrawn under the feed belt 311.

A document stack first stacked on the document stack section 310 is loaded on the feed belt 311 and the movable pushing plate 317 that will be described later. Then, the document stack is aligned by a width stopper plate 316 that regulates the document stack in the width direction, and at the same time the leading ends of the documents come into contact with a document leading end stopper 318 so that the leading ends of the documents are aligned. At this time, the separation lever 315A is pushed downward by the weight of the document stack, so that the lowermost layer of the document stack is lightly pushed upward. An oscillatory paper holding lever 310Z provided upstream of the separation lever 315A helps a returned document to be positively inserted below the document stack, and the document surface is lightly pressed by the weight of the paper holding lever 310Z. The paper holding lever 310Z is effective to stabilize the operation of the separation lever 315A when curled documents or a small number of documents are conveyed.

Figure 5:
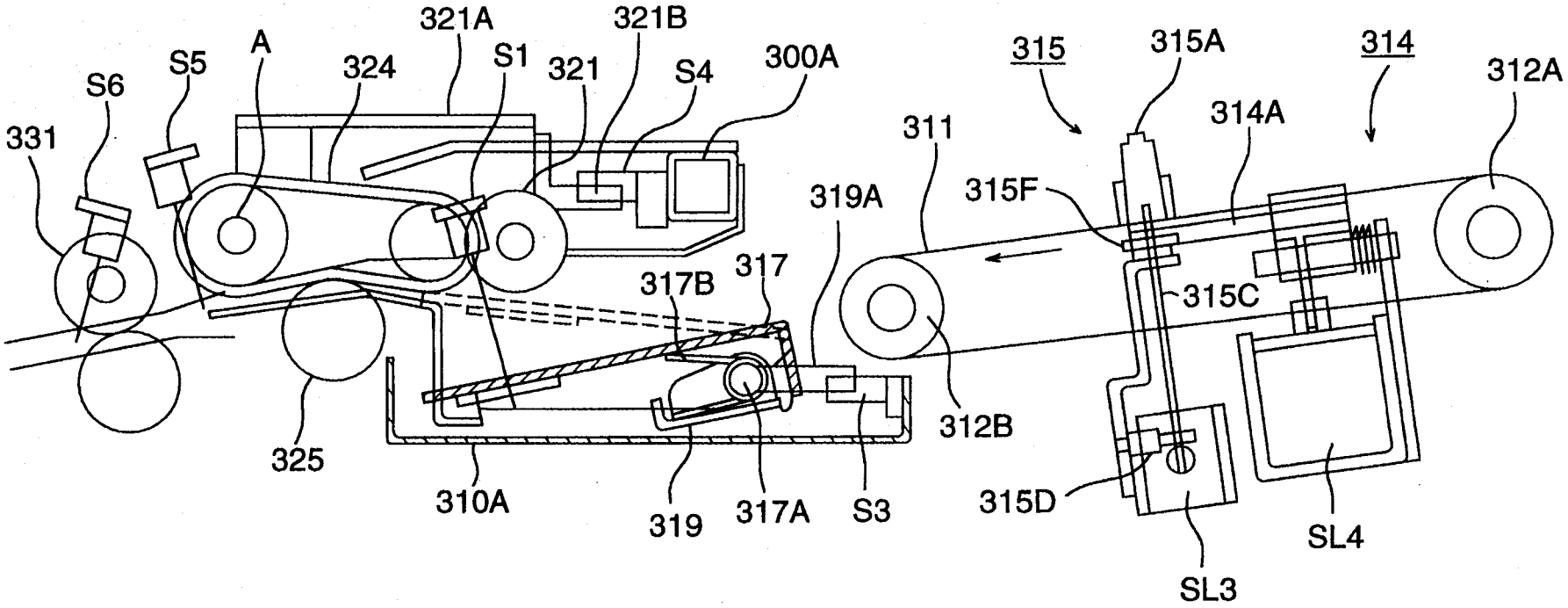
FIG. 5 is a sectional front view of the document stack section and supply section.
Figure 6:
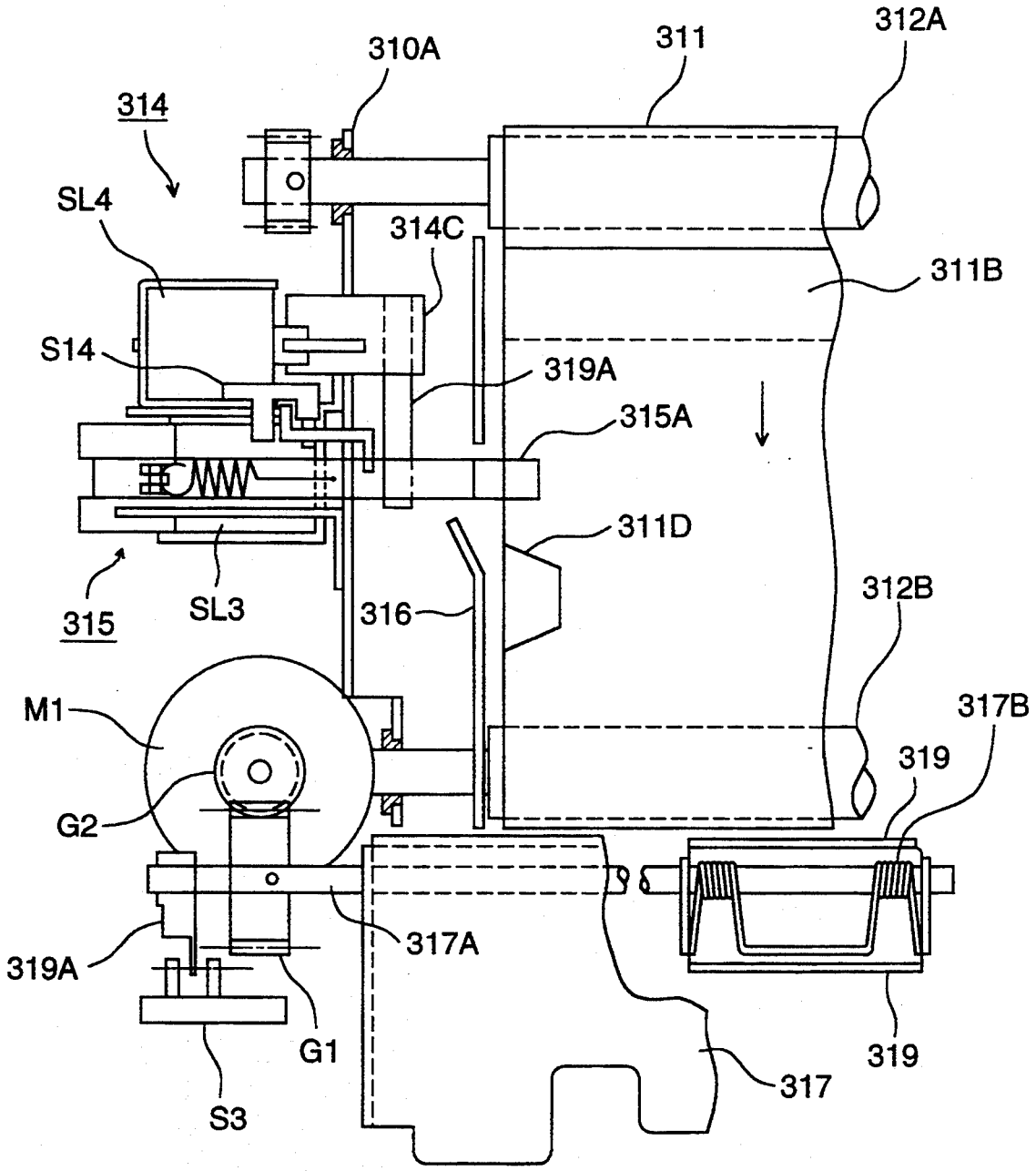
FIG. 6 is a plan view of a copy number classifying means and pushing means.
Figure 7:
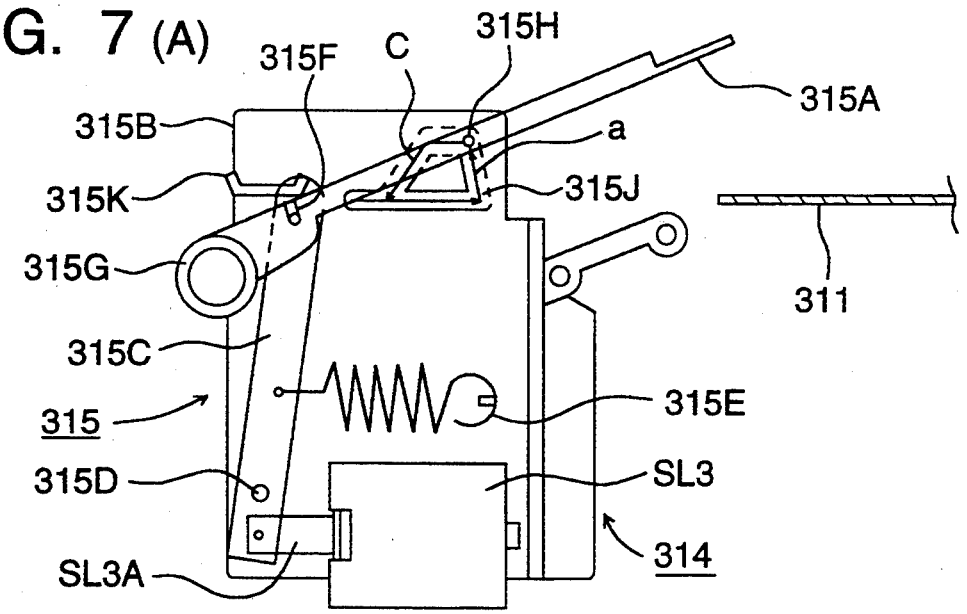
FIGS. 7A to 7E are side views showing the operation of the copy number classifying means.
Figure 7:
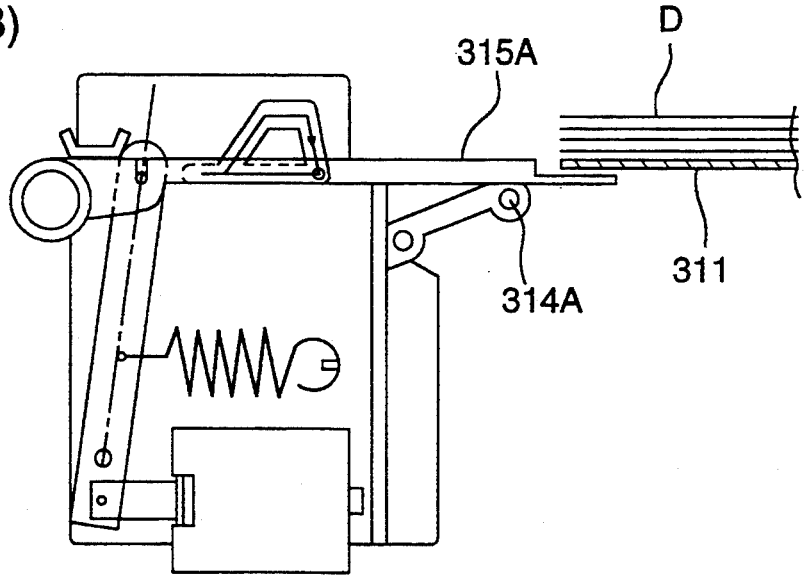
Figure 7:
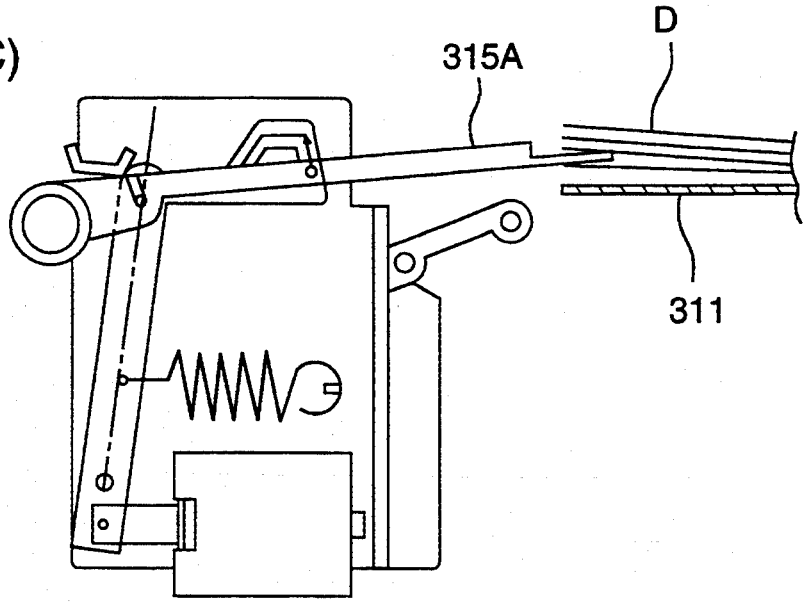
Figure 7:
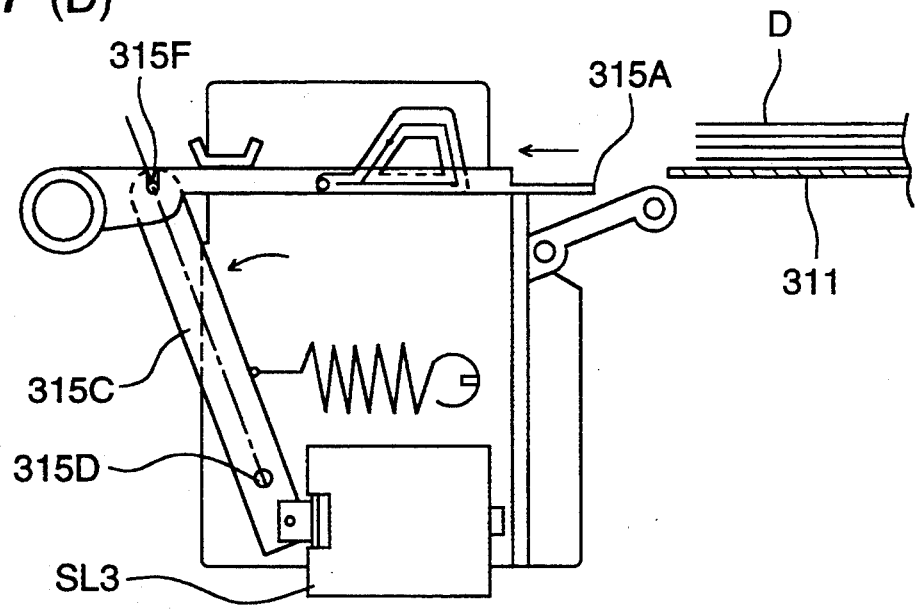
Figure 7:
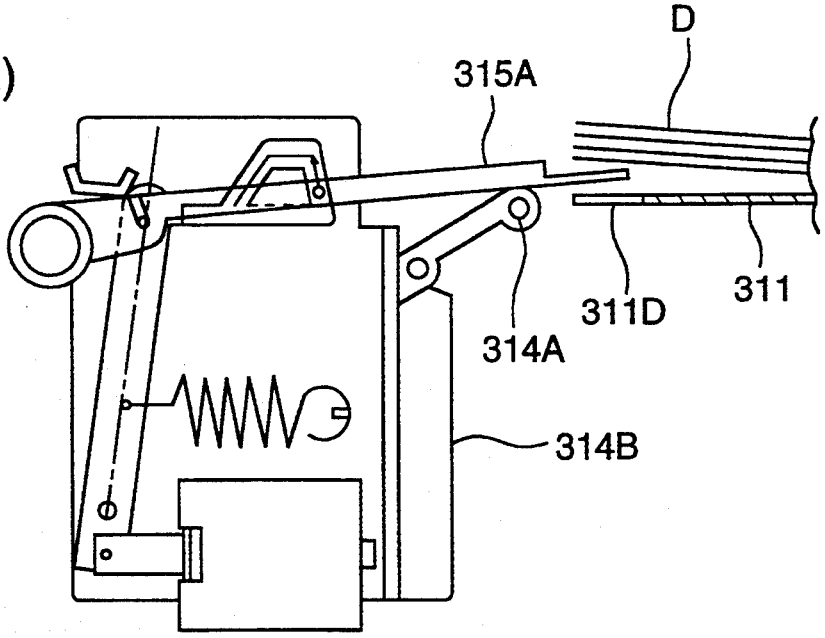

FIG. 5 is a front sectional view of the document stack section 310 and the feed section 320, FIG. 6 is a plan view of the separation means 315, FIG. 7 is a side view showing the operation of the separation means 315.

As shown in these drawings, the separation means 315 and the lifting means 314 are secured to the fixed side plate 310A to which the drive roller 312A and the idle roller 312B are attached. That is, in a position close to the one side of the feed belt 311, the lifting means 314 is secured on the upstream side, and the separation means 315 is secured on the downstream side.

Solenoid SL3 is secured to the lower portion of the base plate 315B of the separation means 315, and one end of the plunger SL3A of the solenoid SL3 is connected with the lower portion of the oscillating lever 315C through a pin. The oscillating lever 315C can be oscillated around the shaft 315D implanted in the base plate 315B, and is pushed in one direction by the action of the spring 315E. The upper end portion of the oscillatory lever 315C is connected with the separation lever 315A through the pin 315F. The separation lever 315A can be oscillated around the pin 315F, and the separation lever 315A can be inclined so that the left end portion of the separation lever 315A can be lowered by the action of the weight 315C when any regulating force is not applied.

A pin 315H is implanted in the middle portion of the separation lever 315A, and the pin 315H can be moved along the D-shaped cam groove 315J formed on the base plate 315B. Numeral 315K is a circular leaf spring attached to the base plate 315B, which slidably comes into contact with the upper surface of the separation lever 315A and serves as a guide surface when the separation lever 315A is horizontally moved.

Figure 8:
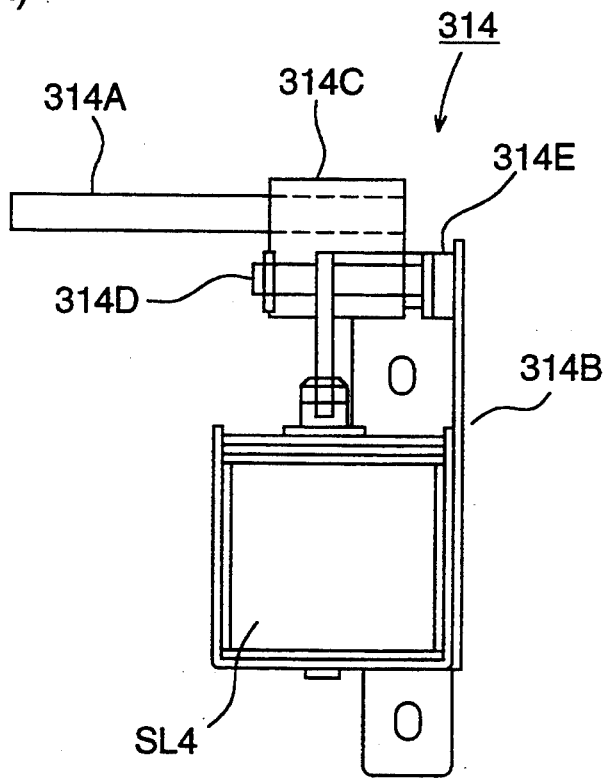
FIG. 8A is a front view of the pushing means.
FIG. 8B is a side view of the pushing means.
Figure 8:
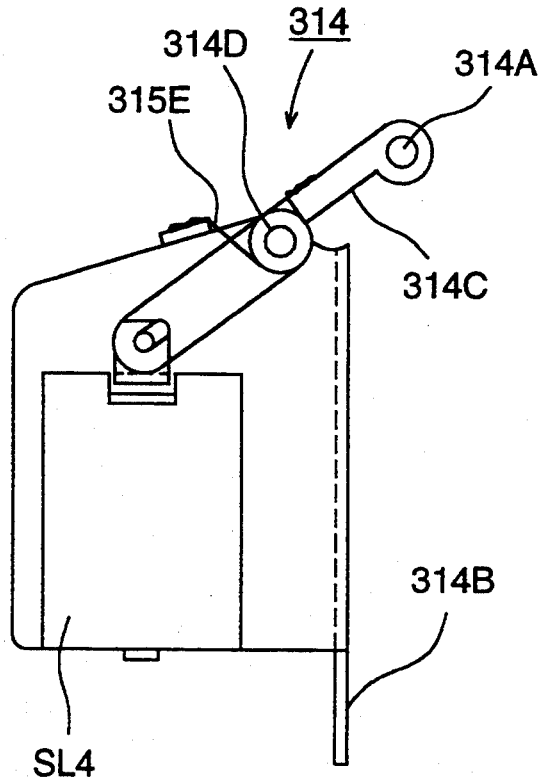

FIGS. 8A and 8B show the pushing means 314 that pushes up the end portion of the separation lever 315A when necessary. FIG. 8A is a front view, and FIG. 8B is a side view.

Solenoid SL4 is fixed to the lower portion of the base plate 314B of the separation lever pushing means 314. One end of the plunger SL4A of the solenoid SL4 is connected with one end portion of the oscillatory lever 314C through a pin. The oscillatory lever 314C can be oscillated around the shaft 314D implanted in the upper portion of the base plate 314B, and is pushed in one direction by the torsion spring 315E. The base portion of a long rod-shaped pushing lever 314A is engaged with the other end of the oscillatory lever 314C, and the end portion of the lever is protruded. The pushing lever 314A comes into contact with the lower surface of the end of the separation lever 315A, and the separation lever 315A is supported so that it can be raised or lowered.

FIG. 7A shows a state of the device in which a document stack is not loaded on the feed belt 311 of the document stack section 310. Under this condition, the separation lever 315A is inclined by the weight 315C, so that the right end of the separation lever is raised (the first position). In this case, the pin 315H is located at an upper dead point of the cam groove 315J, and stopped in this position. When the separation lever 315A is located in this raised position, the separation sensor S14 is turned off.

FIG. 7B shows a state in which a document stack D is loaded on the feed belt 311 of the document stack section 310 and the end portion of the separation lever 315A is lowered by the weight of the document stack D. In this case, the pin 315H of the separation lever 315A is lowered along the passage "a" of the cam groove 315J, and passes through the cutout portion 311D of the feed belt 311, and then stops when it comes into contact with the pushing lever 314A that is under a stop condition (the third position). When the separation lever 315A is lowered in the aforementioned manner, the separation sensor S14 is turned on. At this time, the end portion of the paper holding lever 310Z presses the upper surface of the document stack by its weight.

FIG. 7C is a side view showing the moving process of the separation lever 315A. When the documents of the document stack provided on the document stack section 310 are conveyed out by the top-feed-bottom-return system, the end of the separation lever 315A is pinched between the last page of the document stack and the first page of the returned documents, and as the returned documents are increased, the end of the separation lever is raised. When the first page of the returned documents has reached the uppermost position, the device is brought to a condition shown in FIG. 7A, and the separation lever jumps up. At this time, the separation sensor S14 is turned off.

FIG. 7D shows a state in which the separation lever 315A has been withdrawn to the left by the attracting action of the solenoid SL3 (the second position). When a voltage is impressed upon the solenoid SL3, the plunger SL3 is attracted, so that the oscillatory lever 315C is oscillated around the shaft 315D counterclockwise in the arrowed direction. Therefore, the separation lever 315A connected by the pin 315F is moved to the left. The pin 315H implanted in the separation lever 315A is moved downward along the passage "c" of the cam groove 315J, and comes into contact with the left end of the cam groove 315J and the movement of the pin is stopped. At this time, the leaf spring 315K is slidably contacted with the upper surface of the separation lever 315A, so that the separation lever 315A can be prevented from jumping up.

After a predetermined period of time has passed, the solenoid SL3 is turned off. Then, the oscillatory lever 315c is rotated clockwise around the fulcrum 315D by the action of the spring 315E, so that the lever 315A is moved to the right. At this time, the leaf spring 315K maintains the lever 315A horizontal, so that the pin 315H is moved to the right in the passage "b". Therefore, the end portion of the lever enters the cutout portion 311D of the feed belt 311, and the lever is rotates being raised by its weight. Accordingly, the lever comes into contact with the lower surface of the document.

FIG. 7E is a side view showing a state in which the separation lever 315A is raised by the pushing lever 314A by a predetermined height. On one side of the feed belt 311, the cutout portion 311D is formed for the purpose of allowing the separation lever 315A to withdraw downward. When the feed belt 311 is rotated conveying a document stack loaded on it, there is a possibility that failure in conveyance occurs when the cutout portion 311D collides with the lower layer of the document stack. In order to prevent the occurrence of conveyance failure, one side of the document stack is pushed upward before the cutout portion 311D passes through the upstream side of document conveyance so that the document stack can not interfere with the feed belt 311. That is, when the first exposed document is discharged and returned to the bottom of the document stack on the feed belt 311 of the document stack section 310, the separation lever 315A is raised by a predetermined height so that the separation lever 315A can be positively located above the feed belt 311, that is, the separation lever 315A can be positively located above the cutout portion 311D preceding the protruding gripper section 311B. In this way, the related portion of the document stack is withdrawn upward. For that reason, the solenoid SL4 is operated by a signal of document replacement so that the plunger SL4A is attracted and the oscillatory lever 314C is oscillated around the shaft 314D. In this way, the pushing lever 314A is raised. When the pushing lever 314A is oscillated, the separation lever 315A is raised by a predetermined height and stopped. Due to the foregoing, one end of the document stack is raised, so that the cutout portion 311D of the feed belt 311 is allowed to pass through.

As shown in FIGS. 2, 3, 5 and 6, the movable pushing plate 317 of the movable pushing means is secured on the downstream side of document flow of the feed belt 311, and the drive plate 319 is secured with screws to the oscillatory shaft 317A supported by a bearing attached on both side plates that are integrated with the fixed bottom plate 310B, and accordingly they can be integrally oscillated. The resilient deformation member (for example, a torsion spring) 317B is wound around the oscillatory shaft 317A, and both end portions are respectively contacted with the drive plate 319 and the movable pushing plate 317 so that they are pushed by the spring force. At this time, the movable pushing plate 317 and the drive plate 319 are pushed in a direction in which the torsion spring 317B is opened, however, the lower end portion of the movable pushing plate 317 comes into contact with an end of the drive plate 319 in order to regulate the opening angle between the two not to be larger than a predetermined value. The force of the torsion spring 317B is adjusted to a predetermined value.

An actuator section (a shading plate section) 319A is protruded from one end of the oscillatory shaft 317A. The actuator section 319A can be oscillated around the oscillatory shaft 317A. The actuator section 319A turns on and off the optical path of the pushing home position sensor (for example, a photointerrupter) S3 so that the home position of the drive plate 319 can be detected. A gear G1 is secured to one end of the oscillatory shaft 317A, and connected with a gear G2 secured to the drive shaft of the pushing motor M1 (shown in FIG. 6).

The document leading end stopper 318 is secured to the automatic document feeder body at a position close to the end portion of the document flow of the movable pushing plate 317.

A feed section 320 is provided above the movable pushing plate 317. The feed section 320 includes a delivery roller 321, drive roller 323, idle roller 322, feed belt 324 provided around both rollers, and reverse roller 325 for preventing double feeding, wherein the reverse roller 325 is located below the feed belt 324. The drive force of the drive motor M2 is transmitted to the drive roller 322 through the electromagnetic clutch CL1.

A frame 321A supporting the delivery roller 321 can be freely oscillated around a shaft A. The actuator section 321B is integrated with the frame 321A and protruded from its end. The actuator section 321B turns on and off an optical path of the detection sensor S4 fixed at a predetermined position of a fixed stay member 300A of the automatic document feeder 300.

Figure 9:
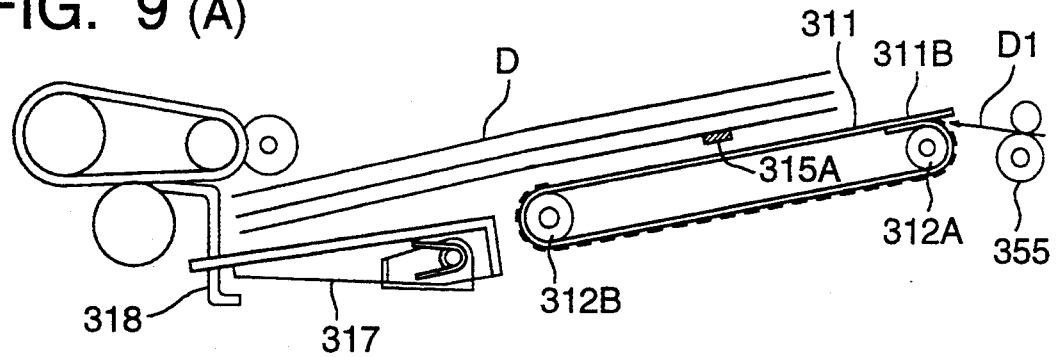
FIGS. 9A to 9E are schematic illustrations showing a document conveyance path in the document circulation mode on a document stack section.
Figure 9:
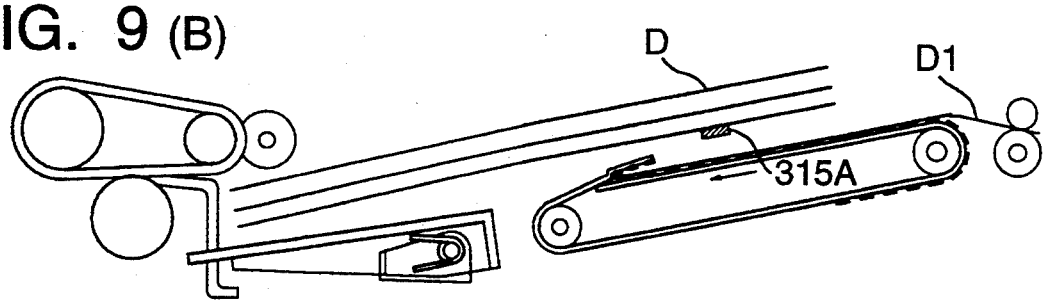
Figure 9:
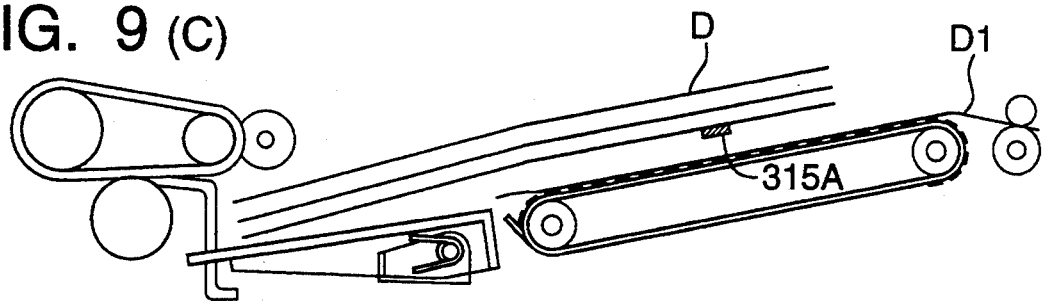
Figure 9:
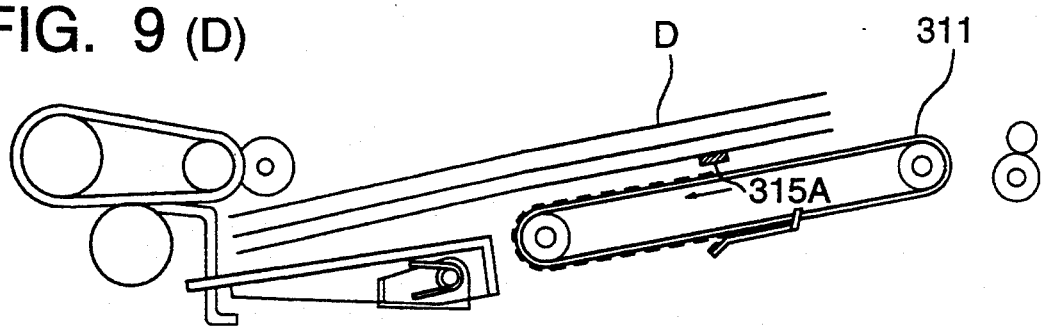
Figure 9:
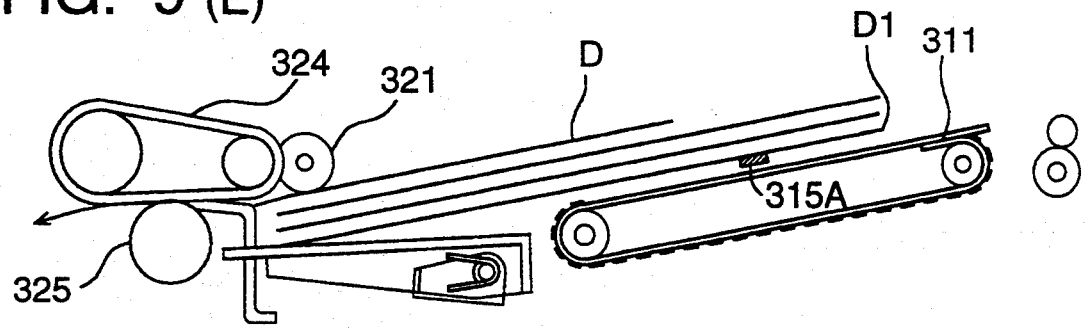

FIGS. 9A to 9C are schematic illustrations showing a conveyance condition of documents D conveyed from the paper discharging and reversal section 350 to the feed belt 311 and the movable pushing plate 317 of the document stack section 310.

After the leading end of document D1 has been detected by the leading end passage sensor S9, a predetermined period of time passes so that the leading end of the document approaches the gripper section 311B. Then the clutch is connected, and the leading end of the document D is held by the gripper section 311B of the feed belt 311 that starts rotating from the home position. When the feed belt 311 is further rotated, the document D is held on the rough surface of the feed belt 311, and conveyed to the left and inserted below the lowermost layer of the document stack that has not been processed yet (shown in FIGS. 9A and 9B). As described before, the separation lever 315A passes through the cutout portion 311D of the feed belt 311 by the action of the pushing lever 314A being driven by the solenoid SL4. Accordingly, the document stack is raised to a predetermined height by the separation lever 315A.

At this time, the movable pushing plate 317 is located at a lower position, and the leading ends of the document stack D are separated from the delivery roller 321. In this case, the surface speed of the feed belt 311 is set slightly faster than that of the circulation discharging roller (offset correction roller) 355 of the paper discharge and reversal section 350, or the surface speed of the feed belt 311 is set equal to that of the circulation discharging roller 355 of the paper discharge and reversal section 350. In this case, since the surface of the feed belt 311 that comes into contact with the document D is rough, the document is pressed against the feed belt 311 by its weight and positively held and conveyed by the feed belt 311 (shown in FIG. 9C).

Moreover, the surface of the feed belt 311 that comes into contact with the lowermost layer of the document stack D is slippery. Therefore, the feed belt 311 smoothly slides coming into contact with the lower surface of the document stack.

The document D held by the feed belt 311 is conveyed in the following manner. When the conveyance direction of the gripper section 311B of the feed belt 311 is changed downward when the feed belt 311 rotates along the idle roller 312B, the document D separates from the gripper section 311B and slides on the movable pushing plate 317 located a little lower than the upper surface of the feed belt 311. Then the document D collides with the document leading end stopper 318, and the document D is stopped (shown in FIG. 9C). Accordingly, when the overall circumferential length of the feed belt 311 is set to be longer than the maximum length of the document D to be conveyed in the forward direction, the document returning operation can be smoothly performed.

When the leading end of the document D1 collides with the document leading end stopper 318, the document D1 is stopped while the latter half of the document D1 is located on both the rough and slippery surfaces on the feed belt 311 (shown in FIG. 9D).

The feed belt 311 is further rotated and stopped at the home position. At this time, the slippery surface of the feed belt 311 comes into contact with the document (shown in FIG. 9E). Accordingly, when the overall circumferential length of the feed belt 311 is set to be longer than the maximum length of the document D to be conveyed in the forward direction, the document returning operation can be smoothly performed.

With reference to FIG. 2, the intermediate conveyance section 330 is provided downstream of document conveyance of the feed section 320. The intermediate conveyance section 330 includes a pair of first intermediate conveyance rollers 331 that are normally rotated, curved guide plate 332, a pair of second conveyance rollers 333 that are normally and reversely rotates, and a pair of third intermediate conveyance rollers 334. These units form a conveyance passage to convey a document D sent out from the feed section 320, to one end of the platen glass 111.

A reversal means is provided on the left of the platen glass 111 on the left of the third intermediate conveyance rollers 334. A pair of reversal conveyance rollers 335 are always normally rotated by the action of the one-way clutch CL5. Numeral 336 is a curved guide connecting the nip position of the third conveyance rollers 334 with that of the reversal conveyance rollers 335, and the guide 336 forms a document reversal feed passage. A reversal detection sensor is provided in a portion of the document reversal feed passage so as to detect the passing of a reversed document. Numeral 337 is a changeover claw.

On the platen glass 111, there is provided a conveyance belt 341 that winds around the drive roller 342, idle roller 343, four document holding rollers 344, and tension roller 345. Therefore, the belt 341 can be rotated around the rollers. A clutch and brake are mounted on the shaft of the drive roller 342, and the drive roller 342 is driven by the drive force of the drive motor M2.

The paper discharge and reversal section 350 includes paper discharge rollers 351, 352, changeover claws 353, 357, reversal conveyance roller 354, circulation paper discharge roller 355, and guide plates 356A, 356B, 356C. The paper discharge rollers 351, 352, paper reversal discharge roller 354 and circulation paper discharge roller 355 are driven by the paper discharge motor M3. The paper discharge roller 353 and the circulation paper discharge roller 355 are normally driven by the paper discharge motor M3, and the reversal conveyance rollers 351, 354 are driven normally and reversely. The changeover claw 353 is driven by the changeover solenoid SL1. The changeover claw 357 is driven by the changeover solenoid SL2.

A paper discharge tray section 360 is provided in the upper portion of the copier body 100 at a position close to the paper discharge opening of the paper discharge reversal section 350 of the automatic document feeder 300. The paper discharge tray section 360 includes a fixed tray 361 having an inclined surface secured to the upper surface of the casing of the copier body 100 with screws, and a movable tray (resin tray) 363 pivotally mounted on the fulcrum shaft 362 provided at one end of the fixed tray 361 so that the movable tray 363 can be oscillated. Under the condition that the movable tray 363 is folded, the inclined upper surface of the fixed tray 361 and the inclined lower surface of the movable tray 363 maintains a predetermined interval and forms a reversal paper discharge passage 364. A document D sent from the reversal paper discharge roller 354 goes up in the reversal paper discharge passage 364 and temporarily stops, and is successively introduced into the automatic document feeder 300 by the reverse rotation of the reversal paper discharge roller 354. In the ADF mode of one-sided documents, the document D passes through the guide 356c, and is discharged outside by the paper discharge roller 352 of the paper discharge reversal section 350, and the discharged document is stacked on the upper surface of the movable tray 363.

Under the condition that the movable tray 363 of the paper discharge tray section 360 is oscillated and developed, the upper surface side of the fixed tray 361 is extended onto the upper surface side of the movable tray 363. Consequently, a large-sized document such as a document of A2 and a fan-folding paper (CCF) can be discharged.

In the reversal circulation mode (R-RDH) of two-sided documents, the changeover claws 357 is changed over downward, and the document D conveyed into the reversal paper discharge passage 364 passes through the reversal paper discharge roller 354, guide plate 356C, 356B and circulation paper discharge roller 355, and is returned to the document stack section 310.

Figure 10:
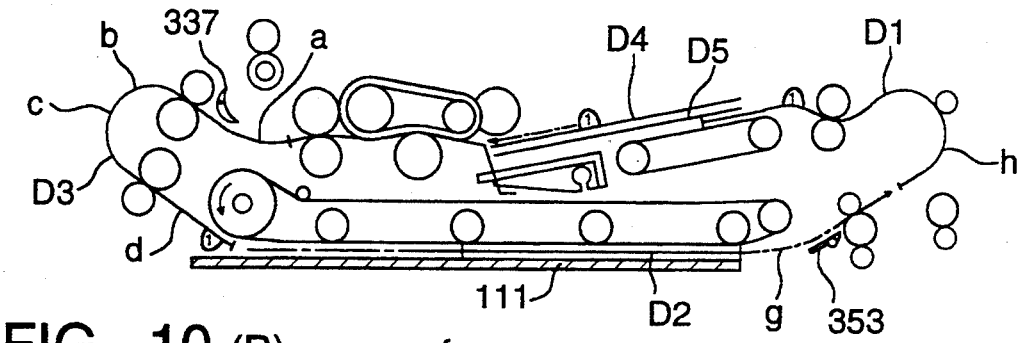
FIGS. 10A to 10D are schematic illustrations showing a document conveyance path in the RDH mode and R-RDH mode.
Figure 10:
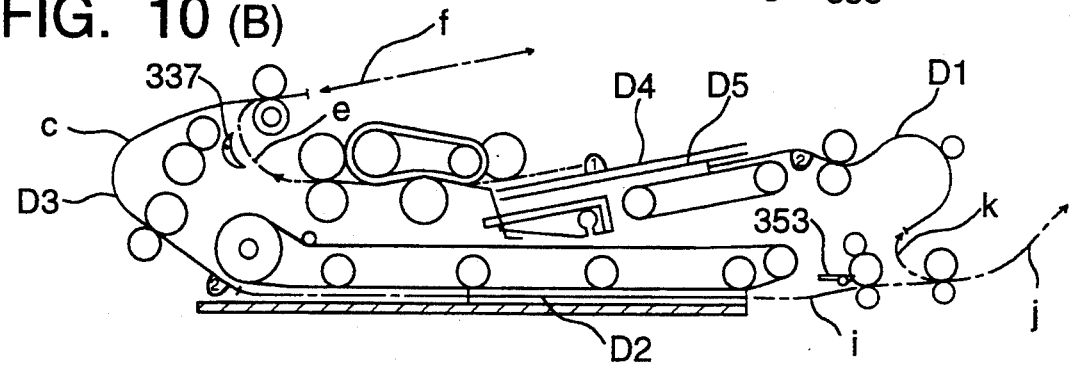
Figure 10:
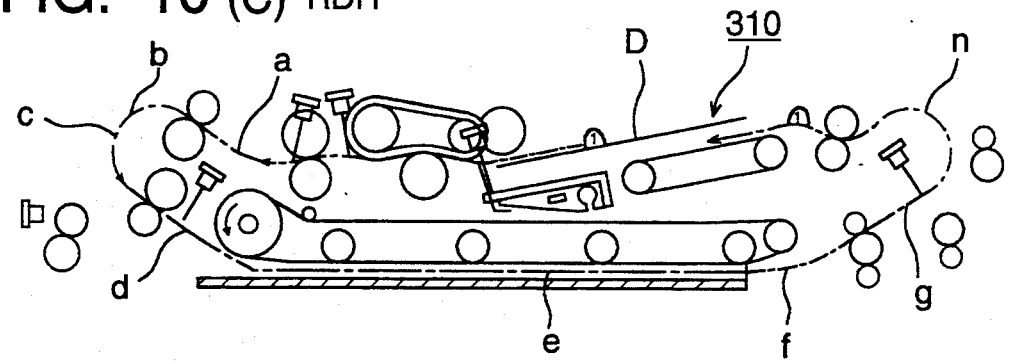
Figure 10:
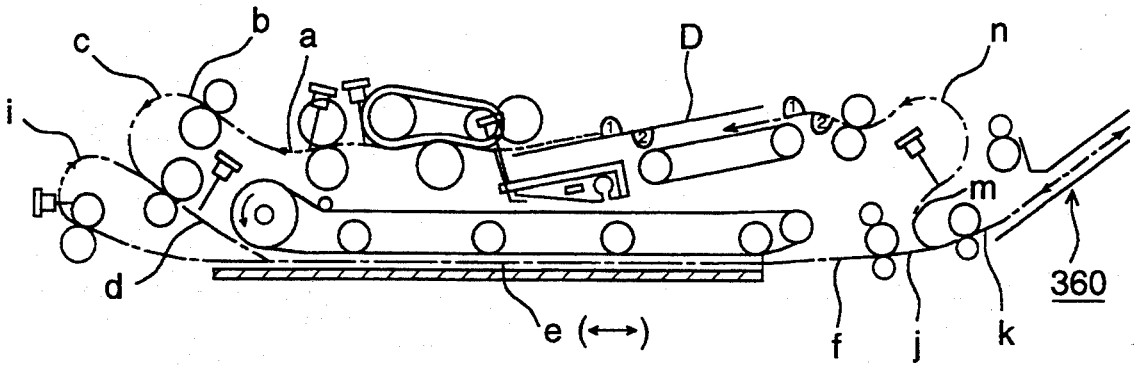

FIGS. 10A and 10B are schematic illustrations showing a document conveyance passage in the RDH mode. FIG. 10A shows a document normal conveyance circulation passage used for copying the first surface of the document, and FIG. 10B shows a document reverse conveyance passage used for copying the second surface of the document.

In the case where the first surface of the document D is exposed on the platen glass 111, the document D passes under the changeover claw 337 that has been stopped at a higher position, and passes through the passages "a" "b" "c" and "d", and is conveyed in the first paper feed passage connected with the platen glass 111. After the document D has been exposed, it passes on the upper surface of the changeover claw 353, and passes through the passages "g" and "h", and enters the gripper section 311B of the feed belt 311.

When the second surface of the document D is exposed, the changeover claw 337 is oscillated upward so that the document D is introduced to the passage "b". The document D further passes in the passages "a", "e" and "f" along the upper surface of a large diameter roller. After the document D has temporarily stopped, it is reversed and then enters the second feed passage connected with the platen glass surface 111 through the passages "c" and "d", and the second surface of the document D comes into contact with the platen glass 111. After the second surface of the document D has been exposed, it branches to the lower side of the changeover claw 353, and passes in the passages "i" and "j". After the document D has been temporarily stopped, it passes through the passage "k", and is reversed again. Then, the document D is inserted into the gripper section 311B of the feed belt 311 under the condition that the first surface of the document is positioned upward.

In the middle of the paper feed delivery passage "d", the document passing synchronization sensor PS2 is disposed. When the leading end of the document passes through the sensor PS2, a detection signal is sent from the sensor, and the document conveyance timing is controlled by the signal. That is, the sensor PS2 controls the operations of the document stopper 112, drive motor, paper feed clutch and conveyance clutch through a clock timer.

The document D fed from the delivery passage "d" is sandwiched between the rotating conveyance belt 341 and the platen glass 111 provided on the copier body 100, and conveyed on the platen glass 111 by the conveyance belt 341. Then, the document D stops at a position where the leading end of the document D collides with the document stopper 112 that is protruded from the left upper surface of the platen glass 111 by the action of a latch type solenoid.

After the document d has been placed on the platen glass 111, it is exposed by the scanning exposure section 110 in the copier body 100, and the document image is formed on a recording body.

After exposure, the document passes through the document stopper 112 that has been withdrawn, and advances to the paper discharge reversal section 350.

FIGS. 10C and 10D are schematic illustrations showing a document conveyance passage (shown by a one-dotted chain line) in the RDH and R-RDH modes.

FIG. 10C is a schematic illustration of the RDH mode in which a document circulation conveyance operation is illustrated in the case of one-sided document and one-sided copy. The one-sided document D passes through the normal circulation passages a, b, c, d and e. After exposure, the document D passes through the passages f, g and n of the paper discharge reversal section 350. Then, the leading end of the document enters the gripper section 311B of the feed belt 311 of the document stack section 310, so that the document is conveyed by the feed belt 311 and returned below the lowermost layer of the document stack.

FIG. 10D is a schematic illustration of the document circulation conveyance of the R-RDH mode in the case of two-sided document and two-sided copy. The odd number surfaces of two-sided documents are exposed when they pass through the same passage as that of the RDH mode described before. Therefore, a copy sheet, on the one side of which an image has already been copied, is stacked on the ADU 180. A document, the one side of which has already been exposed in the passage e on the platen glass, is reversed in the reversal feed passage i. After that, the document is returned to the passage e on the platen glass, and the other side of the document is exposed. After the exposure operation has been completed, the document D reaches the reversal discharge passages f, j and k, and switched back here and returned to the document stack section 310 through the passages m and n.

Figure 11:
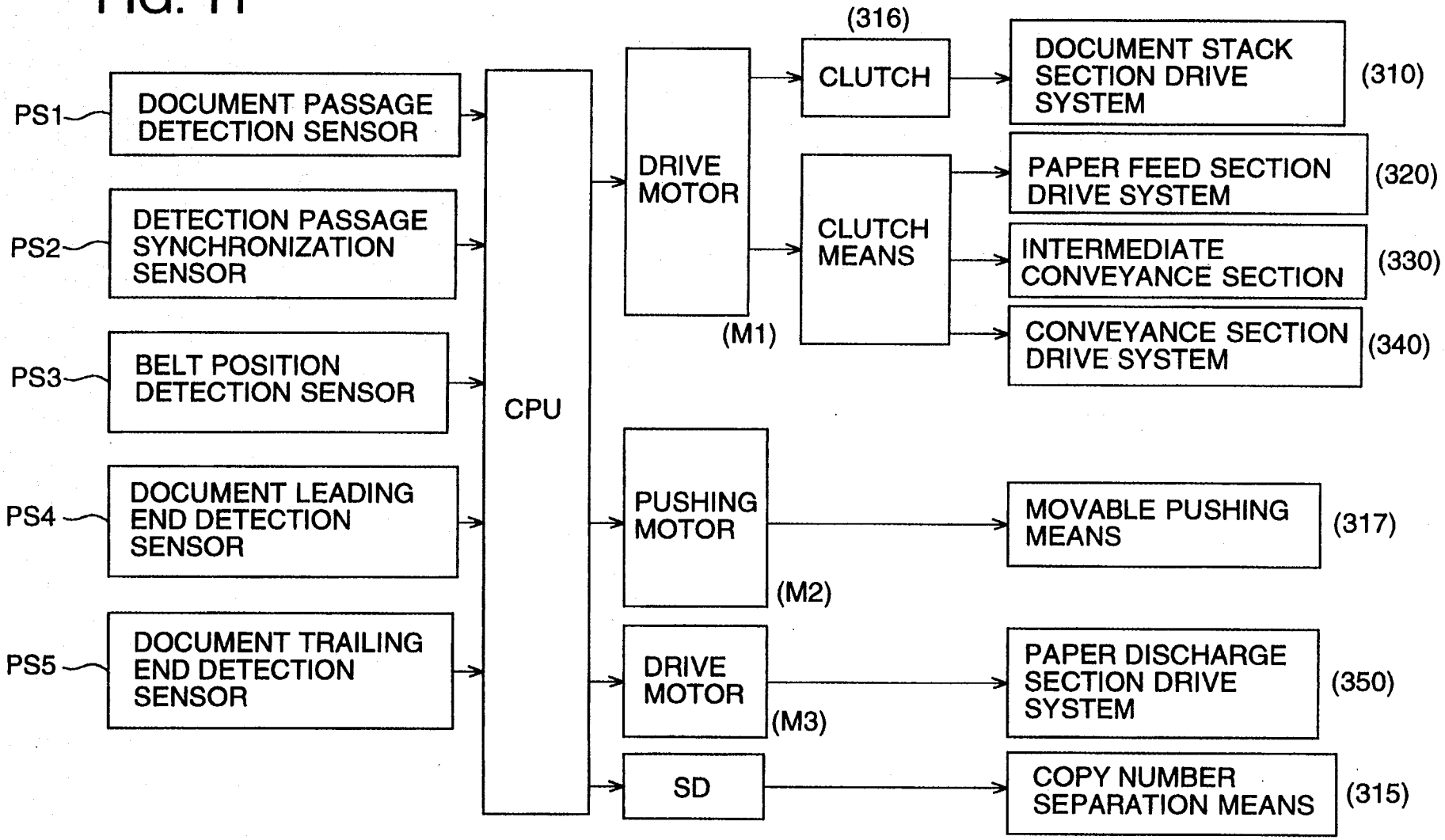
FIG. 11 is a block diagram of the drive system of an automatic document feeder.
Figure 12:
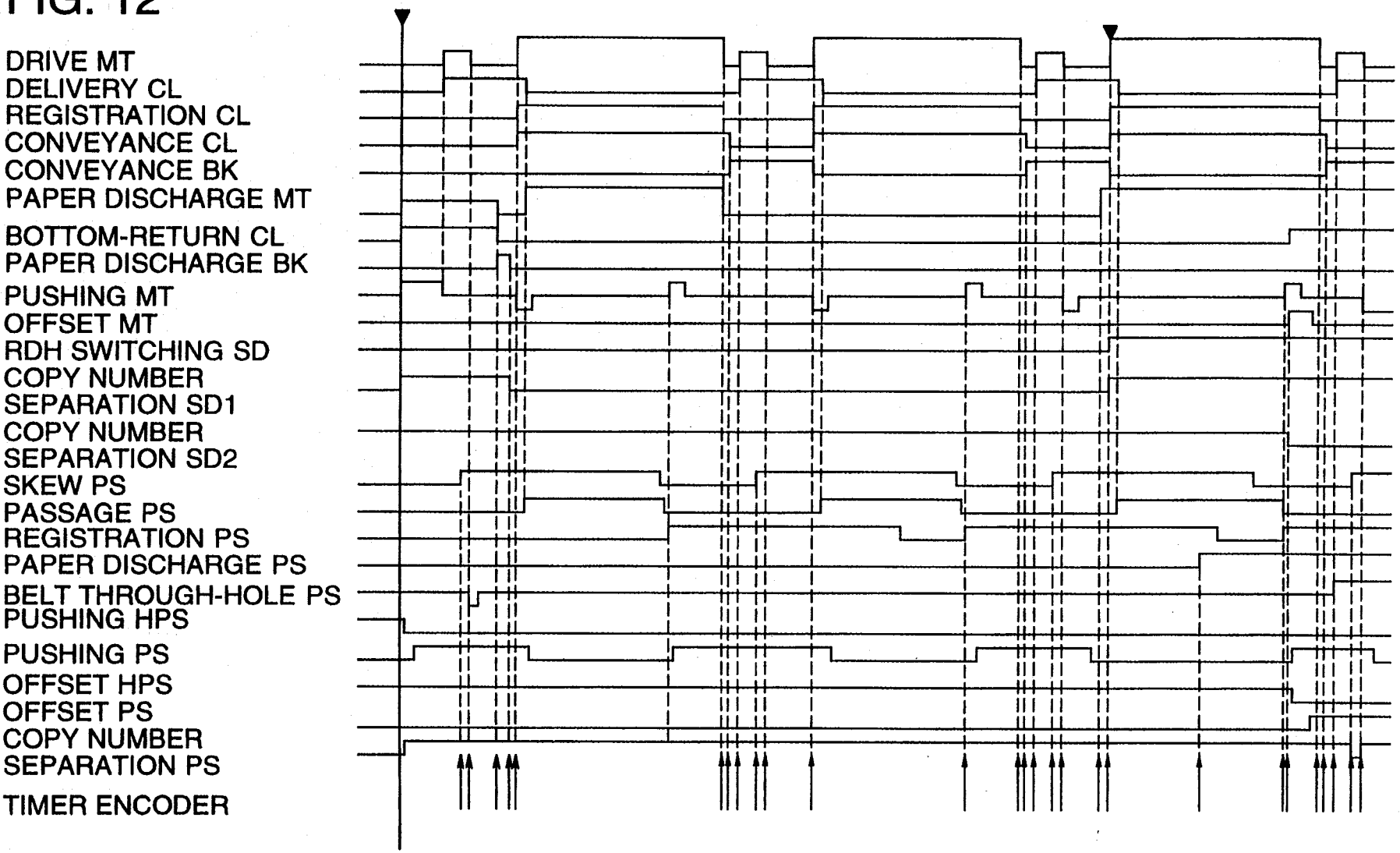
FIG. 12 is a timing chart of the RDH mode of the automatic document feeder.

FIG. 11 is a block diagram of the drive system of the circulation type document feeder (RDH) shown in FIGS. 10A and 10B. All the operations of paper feed and conveyance in the process of document circulation and document reversal circulation are controlled by a CPU. FIG. 12 is a timing chart of document conveyance operations in the RDH mode of the automatic document feeder.

The aforementioned operations are carried out in the case where a one-sided or a two-sided document is copied on one side of a recording paper in the RDH mode. In the case where a two-sided document is copied on both sides of a recording paper, the document is reversed in the first circulation so that the even number pages are copied, and in the second circulation, the odd number pages are copied. Of course, the recording paper feed operation of the copier P is carried out in accordance with the aforementioned operation of the RDH device 300.

In this connection, the feed belt having the gripper section used for the automatic document feeder of the present invention is effective when it is applied to the circulation type document feeder (RDH). In addition to that, the feed belt of the invention can be also applied to a sheet refeed device in which the feed sheet setting section and discharge sheet stacking section are the same. Further, the feed belt 311 on the idle roller 313 side may be extended to a position close to the document leading end stopper 318, and a small movable pressure plate 317 may be pivotally provided just below the feed roller 321. Furthermore, this feed roller 311 may be constituted in such a manner that the feed roller 311 can be vertically oscillated around the drive roller 312.

Figure 13:
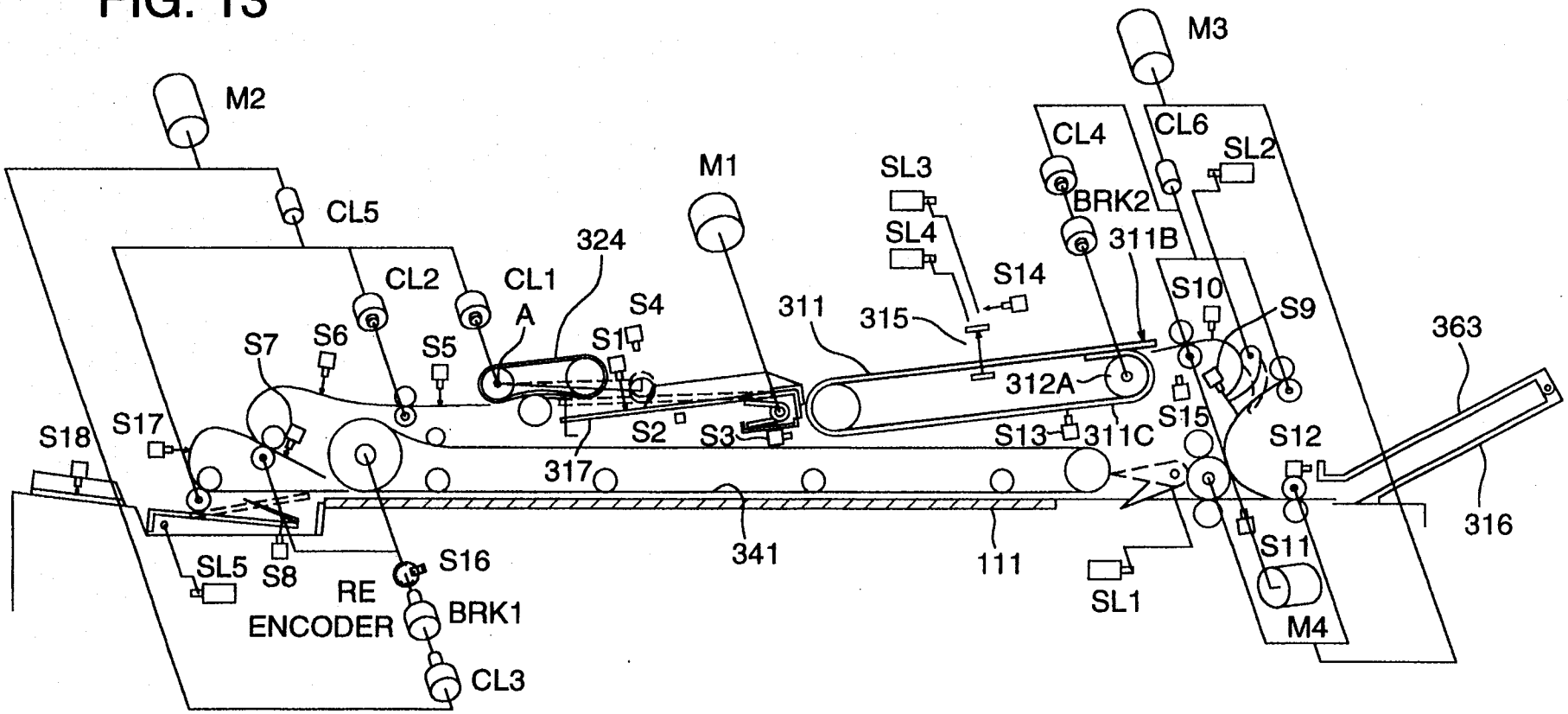
FIG. 13 is an arrangement view showing a drive system of the automatic document feeder.
Figure 14:
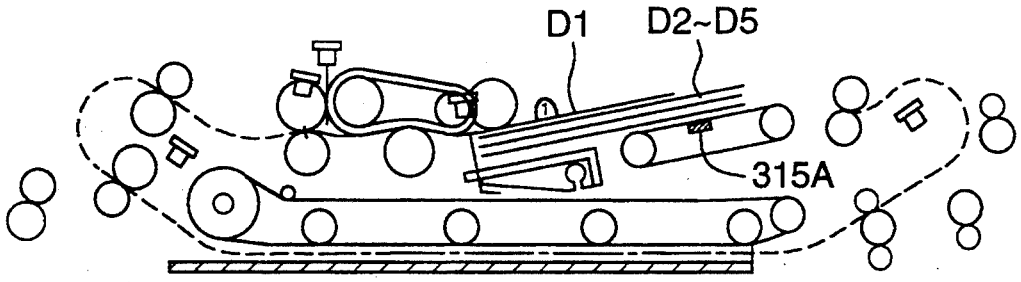
FIGS. 14A to 14F are schematic illustrations showing a document conveyance path for odd-numbered pages in the R-RDH mode.
Figure 14:
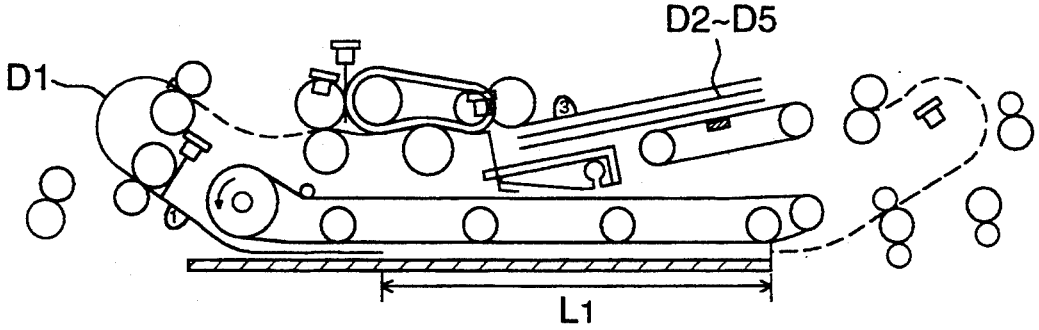
Figure 14:
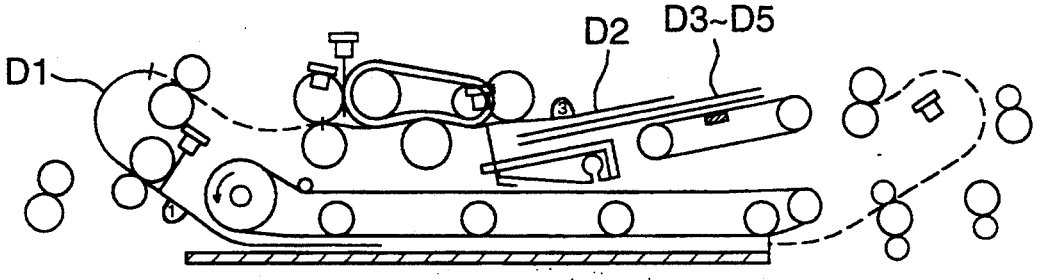
Figure 14:
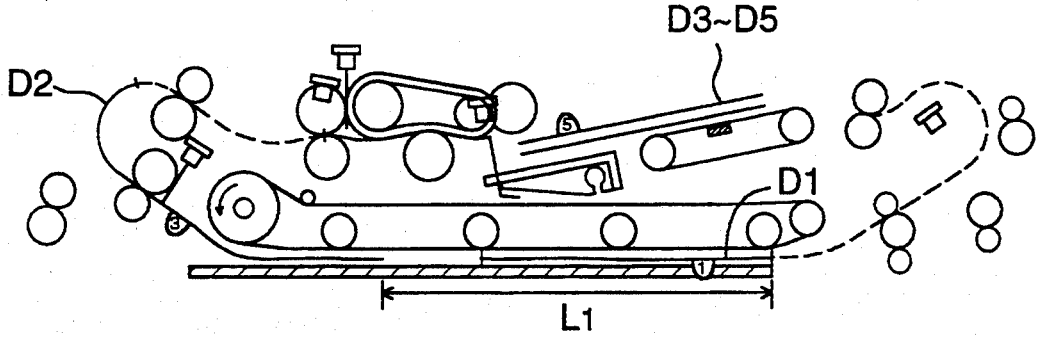
Figure 14:
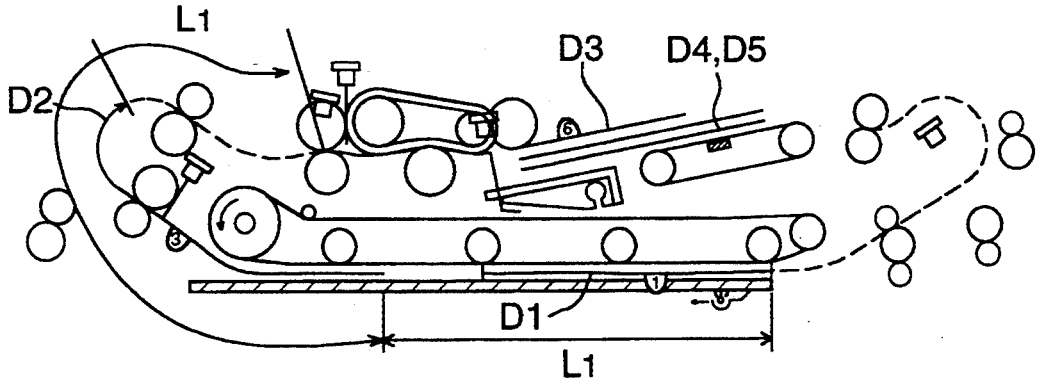
Figure 14:
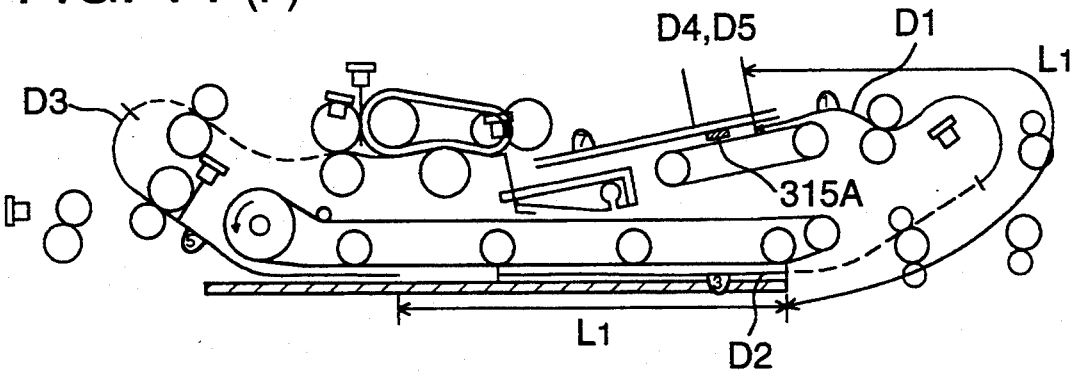

FIG. 13 is a schematic illustration showing the structure of the drive system (power transmission system) of the automatic document feeder 300 explained with reference to FIGS. 10C and 10D. All the operations of paper feed and conveyance in the process of document circulation and document reversal circulation are controlled by the CPU.

The one-sided document circulation conveyance mode (RDH) mode is taken for an example of the document conveyance mode, and described as follows.

(1) Initialization (1A) A main switch of the copier body 100 is turned on, and then the pushing motor M1 is reversed and the offset correction motor M4 is normally rotated. At the same time, the paper discharge motor M3 and the bottom-return clutch CL4 are turned on, so that the drive roller 312A is rotated.

(1B) When the movable pushing plate home position stop main switch is turned on, the pushing motor (stepping motor) M1 is reversed, so that the drive plate 319 is oscillated. Accordingly, the actuator section 319A fixed to the oscillatory shaft 317A turns on the pushing home position sensor S3. By the detection signal, the revers rotation of the pushing motor M1 is stopped, so that the drive plate 319 and the movable pushing plate 317 are stopped at the lowest initial position (home position), which is effective to absorb the time lag of the drive gear and sensor. At this home position stop position, a clearance is provided to accommodate the predetermined maximum amount of document stack D.

(1C) Document Stacking

When the document stack D is stacked on the feed belt 311 and the movable pushing plate 317, the setting detection sensor S1 is turned on, and the mode is set at the ADF mode. At the same time, the size detection sensor S2 is turned on, so that the document size is detected. Then, the R-RDH mode is selectively inputted.

(1D) Home Position Searching Operation of the Offset Correction Roller

The offset correction roller 355 to correct a position of sheet can be moved in a direction perpendicular to the paper conveyance direction, and driven by the offset correction motor M4 that is rotated when the main switch is turned on. The offset home position sensor S15 to detect the roller position is provided outside of the paper passage of the offset correction roller 355.

In the case where the sensor S15 is turned off when the main switch has been turned on, the offset correction motor M4 is rotated, so that the offset correction roller 355 is moved to a side opposite to the viewer's side, and when the sensor S15 is turned on, the motor M4 is stopped. The motor M4 is a step motor, and after it has been stopped, a predetermined voltage is impressed upon the motor, so that the motor is set in a holding condition. In the case where the sensor S15 is turned on, the motor M4 is reversed, so that the roller 355 is moved to the viewer's side and the sensor S15 is once turned off. After that, the motor M4 is normally rotated again, and when the sensor S15 is turned on, the motor M4 is stopped and held. When the above operations are performed, the roller 355 can be always accurately stopped at a predetermined position irrespective of the play in the units from the motor M4 to the roller 355. Usually, an adjustment operation is conducted so that this predetermined position can be located almost in the middle of a capable range of the roller 355.

(1E) Bottom-return Feed Belt Home Position Search Operation

Figure 4:
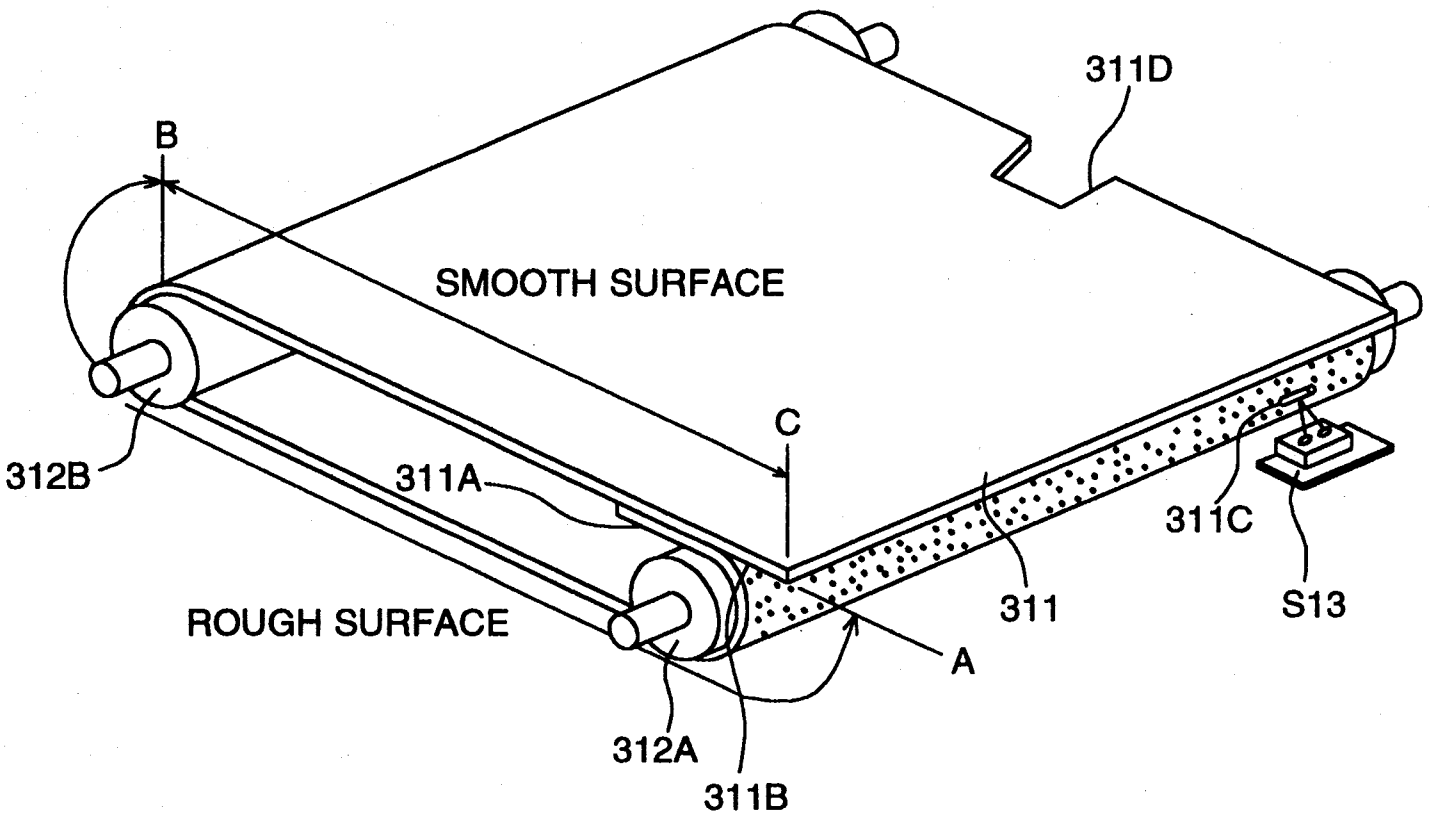
FIG. 4A is a perspective view of the paper feeding belt and related members of the document stack section.
FIG. 4B is a sectional view of a preferable example of the paper feeding belt.
FIG. 4C is a partial enlarged sectional view of the paper feeding belt shown in FIG. 4B.
Figure 4:
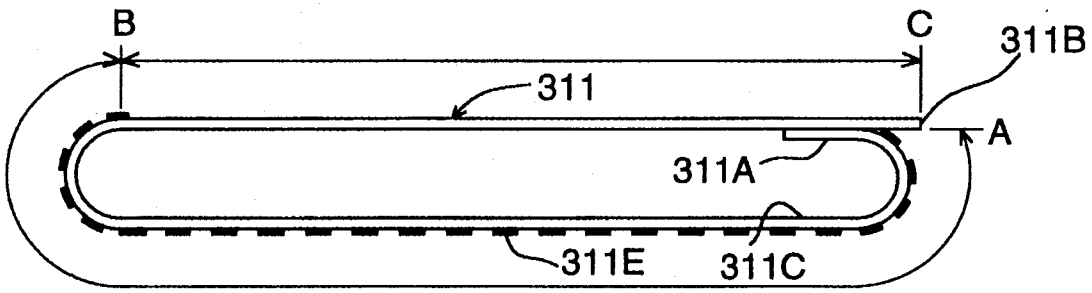
Figure 4:
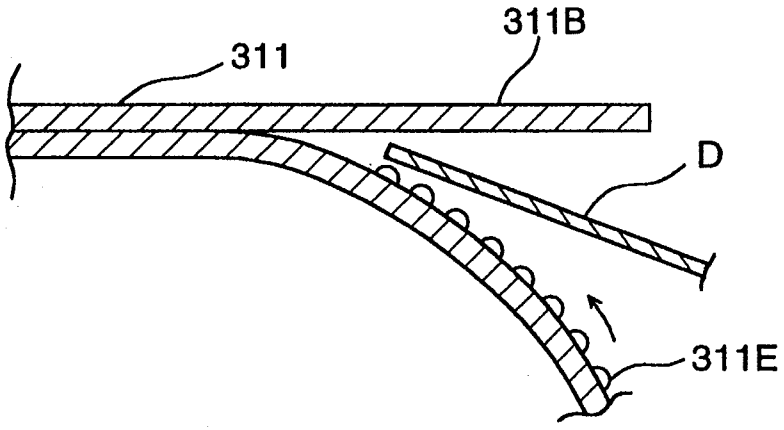

As shown in FIGS. 3 and 4, a through-hole 311C for detecting the home position is formed on the bottom-return feed belt 311 having the gripper section 311B, wherein the belt 311 is provided between the drive roller 312 and the idle roller 313. When the main switch is turned on, the paper discharge motor M3 and the bottom-return clutch CL4 are turned on, so that the drive roller 312 is rotated. The drive roller 312 is driven through the one-way clutch CL6, and always rotated in a direction shown by a solid line irrespective of the rotational direction of the motor M4.

When the home position detection hole 311C on the feed belt 311 passes through the belt home position sensor S13, the sensor S13 is turned off, and after a predetermined period time has passed, the bottom-return clutch CL4 is turned off, and at the same time the paper discharge brake BRK2 is turned on, so that the drive roller 312A is suddenly stopped. In this way, a timed relation is adjusted so that the gripper section 311B of the bottom-return belt 311 can be located on the extension of the offset correction rollers 355 and the cut-out portion 311D can agree with a position of the separation lever 315A.

(2) Document Circulation Conveyance

According to the above initializing operation, document feed preparation work is completed, and successively a document feed operation starts. FIG. 13 is a schematic illustration showing the document conveyance process of odd number pages.

(2A) When the copy button is turned on, the pushing motor M1, paper discharge motor M3 and bottom-return clutch CL4 are turned on, so that an ADF and copy operation can be started.

(2B) When the copy button has been turned on, the bottom-return clutch CL4 is turned on so that a low speed operation of the paper discharge motor M3 is started. Due to the foregoing, the drive roller 312A is rotated, and the feed belt 311 is driven. When the detection hole 311C of the feed belt 311 passes through the belt home position sensor S13, a detection signal is sent from the sensor. According to the detection signal, the feed belt 311 is stopped by the brake BRK2 after a predetermined period of time has passed. After that, the copy number separation solenoid SL3 is turned on, and the separation lever 315A passes through the cut-out portion 311D and comes into contact with the lowermost layer of the document stack.

(2C) When the copy button is turned on, the pushing motor (stepping motor) M1 is driven, and the movable pushing plate 317 is oscillated through the drive plate 319 fixed to the oscillatory shaft 317A, and the torsion spring 317B. Therefore, an end portion of the movable pushing plate 317 is raised, so that the document stack D is lifted. In this ascent process, the oscillation angle of the oscillatory shaft 317A is converted into a signal by a rotary encoder so that the pulse is counted by the count C1.

(2D) When an upper surface of the document stack D stacked on the movable pushing plate 317 is lightly contacted with the outer circumferential surface of the delivery roller 321 that has been lowered to a predetermined position by its weight, the movable pushing plate 317 raises the delivery roller 321 while holding the document stack. After the delivery roller 321 has been raised by a predetermined amount, the pushing detection sensor S4 mounted on the end is turned on, so that a counting operation is started. When the delivery roller 321 is further raised, a frame to hold the discharge roller 321 comes into contact with a fixed member not shown, so that the ascending motion of the delivery roller 321 is stopped. However, the drive plate 319 is further rotated counterclockwise while compressing the torsion spring 317B. Accordingly, an interval between the movable pushing plate 317 and the drive plate 319 is reduced. When the pushing detection sensor S4 is turned on, the pushing force becomes the initial setting force (for example, the roller weight 50 g), and the counting operation of the count C1 is stopped.

(2E) Stack thickness of the document stack D is detected by the output of the count C1, and a designation pulse is determined according to the document size detected by the size sensor S2 and the pushing pulse table that has previously been determined by the setting input of a thick or thin paper.

When the document stack thickness is detected by a value provided by the count C1, this document stack thickness is classified to, for example, three steps of "large", "middle" and "small".

The document size is set to be, for example, one of B5 to A3, and detected by the size detection sensor S2. In the case where several sizes of documents are mixed and stacked on the stack section, an operator presses a mixed document button on the operation panel so that the mixed several sizes of documents can be designated. Thickness of a single sheet of document can be designated by pressing a thin paper or a thick paper button provided on the operation panel.

As described above, the document stack thickness and the document size are automatically detected by the sensors, and the mixed several sizes of document and the document paper thickness are manually set by the operator.

In accordance with the aforementioned detected values and the manually set values, a pushing pulse table is previously set and stored in a nonvolatile memory. The count C2 is determined by the above sheet condition inputting means.

(2F) The count C2 is inputted by the aforementioned designated pulse, and further when the drive plate 319 is driven, the counting operation of the count C2 is continued. The drive plate 319 is oscillated until the designated count C2 is counted up. Then, a winding amount of the torsion spring 317B is increased, so that the resilience is approximately linearly varied and the pushing force is increased.

(1A27) When the count C2 is counted up, the movable pushing plate 317 pushes out the document D by a predetermined pushing force (for example, 100 g), and comes into contact with the roller 321 with pressure, and the pushing motor M1 is stopped.

(2G) Concurrently when the pushing motor M1 is stopped due to the completion of counting, the delivery clutch CL1 and the drive motor M2 are turned on, and rotated at low speed, so that a document feed operation is started. That is, the document feed operation is carried out in the following manner: the feed belt 324 is rotated by the drive motor M2 that is driven at low speed; upper documents are sent out by the feed belt 324; and only the uppermost document D1 is separated from other documents by the reverse roller 325.

(2H) The leading end of the aforementioned separated document D1 is detected by the skew correction sensor S5. After a predetermined period time (timer T1) has passed from the generation of the leading end detection signal, the drive motor M2 is turned off, and the registration clutch CL2 is turned off. Due to the foregoing, the document D1 collides with the first intermediate conveyance roller (registration roller) 331, and a loop is formed. During the formation of the loop, the skew of the document D1 can be corrected. (Refer to FIG. 4A.)

(2I) Before the completion of the time measuring operation performed by the timer T1, the paper discharge motor M3 and the paper discharge brake BRK2 are turned off by the action of the timer T2, so that the rotation of the drive roller 312A is suddenly stopped, and the home position of the gripper section 311B of the feed belt 311 is determined.

(2J) When a predetermined period of time has passed after the start of detection of the detection hole 311C of the feed belt 311, wherein the passage of time is measured by the timer T3, the drive motor M2 is driven again. At this time, the drive motor M2 is driven at high speed, and the registration clutch CL2 and the conveyance clutch CL3 are turned on concurrently when the delivery clutch CL1 is turned on, so that the document D1 is conveyed downstream. When the leading end of the document D1 crosses the passage detection sensor S6, the delivery clutch CL1 driving the drive roller 323 is turned off, and the feed belt 324 is idly rotated until the trailing end of the document D1 passes through the sensor S6 and then the feed belt 324 is stopped. However, the document D1 is successively conveyed by the first intermediate conveyance rollers 331 that are driven by the drive motor M1.

(2K) When the timer T3 has counted up, the pushing motor M1 is changed over so that it can be reversed, and the drive plate 319 and the movable pushing plate 317 are lowered so that the pushing action is released. When the home position detection sensor S3 detects that the drive plate 319 has returned to the initial position, the pushing motor M1 is stopped. In the case where a plurality of documents are successively fed, the drive plate 319 and the movable pushing plate 317 are not returned to the home position but stopped at an intermediate position in accordance with a detection signal of the pushing detection sensor S4 and a drive start signal of the drive means.

(2L) After the sensor S13 has detected the passage of the home position detection hole 311C of the feed belt 311, the timer T3 counts the passage of a predetermined period of time. Then, the separation solenoid SL3 of the lifting means 314 is turned off and the lifting lever 314A is lowered. As a result of the foregoing, the separation lever 315A held by the lifting lever 314A is also lowered by its weight, so that the lifting action of one end of the document stack is released, and the lever 314A is withdrawn under the lowermost document of the document stack, and the stopping position of the lever is detected by the sensor S14.

In the case where the document stack is set below the separation lever 315A of the document stack section 310, or the document stack is set into the document stack, the copy number separation sensor S14 does not detect the stopping position. According to the signal, the pushing lever 314A is lowered when the solenoid SL3 is turned off, and when solenoid SL4 is turned on, the separation lever 315A is slid down along the path C shown in FIG. 7A, so that it is withdrawn to a position shown in FIG. 7C. Successively, when the solenoid SL4 is turned off, the separation lever 315A is advanced being pushed by the spring 315E, and reaches a position shown in FIG. 7B. As a result, the separation lever 315A is inserted below the cutout portion 311d of the feed belt 311.

(2M) Next, when the leading end of the document D1 passes through the registration sensor S7 and a signal is sent, a counting operation is started by the encoder sensor S16 directly connected with the drive roller 342 of the conveyance belt 341 and the third intermediate conveyance rollers (registration rollers) 334. After the encoder RE has counted a predetermined number of counts ($\phi 1$), the drive motor M2 is turned off. Further, at this time, the encoder plate RE starts a counting operation, and after a predetermined number of counts ($\phi 2$) has been counted, the registration clutch CL2 and the conveyance clutch CL3 are turned off, and the conveyance brake BRK1 is turned on. In this way, the conveyance belt 341 and the third intermediate conveyance rollers 334 are stopped. At this time, the leading end of the document D1 reaches a predetermined waiting position (a position separate from the stop position by L1, for example 236 mm) on the platen glass 111 and stops (shown in FIG. 4B).

When the leading end of the first document D1 passes through the registration sensor S7 and a detection signal is generated, the pushing motor M1 starts a pushing operation of the drive means according to the detection signal, so that the drive plate 319 and the movable pushing plate 317 are raised, and successively the document D2 is pushed.

(2N) After a predetermined period time has passed from the completion of counting of the encoder plate RE-($\phi 2$), the drive motor M2 and the delivery clutch CL1 are turned on, and the delivery roller 321 and the feed belt 324 are rotated at low speed. Therefore, the document D2 is fed at low speed, and in the same manner as the document D1, the document D2 collides with the first intermediate conveyance rollers (registration rollers) 331 to form a loop, and then the conveyance of the document D2 is stopped. (Refer to FIG. 4C.)

(2O) Then, after a predetermined period of time has passed, the drive motor M2, delivery clutch CL1, registration clutch CL2 and conveyance clutch CL4 are turned on, and the conveyance brake BRK1 is turned off, so that the documents D1 and D2 are conveyed at high speed. At a point of time when the document D1 reaches a predetermined exposure position on the platen glass 111, the drive motor M2 is turned off. Further, when the conveyance clutch CL3 and the registration clutch CL2 are turned off and the conveyance brake BRK1 is turned on, the document D1 is stopped at the exposure position, and at the same time the document D2 is stopped at a predetermined waiting position on the platen glass 111 (shown in FIG. 4D). That is, in this example, a document stopper is not used, and an amount of movement of the document D is controlled when the pulse number of the rotary encoder RE is counted on the basis of the registration sensor S7, and the document D is conveyed to the reading position.

(2P) Under the condition that the documents D1 and D2 are stopped, the document D1 is exposed for scanning in accordance with the signal sent from the copier body (shown in FIG. 4E). In other words, while the document D1 is stopped on the platen glass 111, the first surface (1) is exposed by an exposure lamp of the scanning exposure section 110, and a document image can be formed on a photoreceptor drum through a lens and mirrors, and then a copy process is conducted on the document D1.

During the aforementioned exposure operation, the timer completes its counting operation, and the drive motor M2 and the clutch CL1 are activated, so that the feed belt 324 is rotated and the next document D3 is sent out. When the timer is controlled, a registration operation is carried out, and the document D3 is stopped at a position where an interval between the leading end of the document D3 and the trailing end of the previous document D2 can be maintained to be a predetermined interval L1.

Consequently, at this time, the three documents D1, D2 and D3 are aligned in a row on the conveyance passage from the separation feed means to the reading means. At this time, the document D1 is located in the reading position on the platen glass 21, and the document D2 is located between the conveyance belt 141 and the second intermediate conveyance rollers 132 (the second conveyance rollers), and the document D3 is located at a position where the leading end of the document D3 collides with the registration roller 331. In this way, each of the documents D2 and D3 waits in each waiting position so that the successive conveyance can be stably carried out.

(2Q) Document Replacement

After the exposure operation of the document D1 has been completed, the drive motor M2 is driven at high speed so that the conveyance belt 141 is rotated, and further the paper discharge motor M3 is rotated at high speed. The exposed document D1 passes through the paper discharge reversal section 350, and is returned to the bottom of the document stack section 310.

(2R) When the paper discharge motor M3 is rotated at high speed, the document D1 passes through the reversal paper discharge passage 364 of the paper discharge tray 360, the reversal paper discharge roller 354, and the guide plate 356C. Further, the document D1 passes through the branch section in which the upper passage has already been changed over and opened when the changeover claw 357 is oscillated by the RDH changeover solenoid SL2. When the leading end of the document D1 is detected by the paper discharge sensor S9 in the process of this conveyance operation, a time counting operation is started by the timer. When the counting operation is completed by the timer, the bottom-return clutch CL4 is turned on. In the case where the offset detection sensor S10 is off at this time, the offset correction motor M4 is rotated in a direction opposite to the viewer's side. In the case where the sensor S10 is on, the motor M4 is rotated in a direction of the viewer's side. After the sensor S10 has been turned off, the motor M4 is rotated again in the direction opposite to the viewer's side. Concurrently when the sensor S10 has been turned on, the motor is stopped, and the document collides with the width stopper plate 316 so that the offset of the document is corrected and the document is aligned. In this case, the timer is set so that the bottom-return clutch CL4 can be turned on for the purpose of holding the leading end of the document D1 by the gripper section 311B of the feed belt 311.

In this example, the document conveyance distance from the paper discharge roller 351 to the gripper section 311B is longer than the length of a paper to be processed. However, it is possible to reduce the distance from the paper discharge roller 351 to the gripper section 311B to be shorter than the document length in the following manner: after the trailing end of the document D1 has passed through the paper discharge roller 351, the offset correction motor M4 is turned on by the action of an independent timer.

(2S) Further, when the bottom-return feed belt 311 and the offset correction rollers 355 are rotated, the document D1 is inserted below the upper document stack. In this case, the separation lever 315A of the copy number separation means 315 is lifted upward by a predetermined height by the action of the copy number separation solenoid SL4. Therefore, the document D1, the leading end of which is nipped by the gripper section 311B, is inserted below the lowermost document.

(2T) After the document replacing operation has been completed, the document D4 is further sent out. Since the movable pushing plate 317 is lowered immediately after the completion of registration, the document D1 returning to the document stack tray 310 passes above the lowered movable pushing plate 317, and collides with the document leading end stopper 318 and stops.

(2U) When the document D4 is conveyed to the registration position, the trailing end of the document D4 passes through the separation lever 315A, and the separation lever 315A is moved upward, so that the copy number separation sensor S14 is turned on. In this way, it can be detected that the last document of the first circulation has been sent out.

(2V) After the document D4 has been conveyed to the second stop position, the document D1 returned to the document stack section 310 is sent out again while the document D3 is being exposed. In the same manner, D2, D3 and D4 are sent out, and when D4 is returned, the copy number separation solenoid SL3 is operated so that the separation lever 315A is inserted below the document D4. This operation is repeated by a predetermined copy number.

In this example, after the completion of registration conveyance, the document is returned when the movable pushing plate 317 is lowered. The registration conveyance operation may be conducted after the document has been returned. In this case, the paper holding lever 319 provided upstream of the separation lever 315A assists so that the returning document can be positively inserted below the document stack, and lightly comes into contact with the upper surface of the document by its weight. This paper holding lever 310Z is also effective to stabilize the operation of the separation lever 315A while curled papers or a small number of documents are conveyed.

(3) R-RDH Mode (Two-sided Document Circulation Conveyance Mode)

The aforementioned operation is conducted in a case in which a one-sided document is copied onto one side of a recording sheet. In the R-RDH mode in which a two-sided document is copied onto both sides of a recording sheet, the document is reversed in the first circulation so that only the odd number pages are copied (shown in FIG. 10C), and the even number pages are copied in the second circulation (shown in 10D). Of course, the recording paper feeding operation in the copier body 100 is conducted in accordance with the RDH and R-RDH modes.

FIGS. 15A to 15G are schematic illustrations showing a document conveyance process of the R-RDH mode in which a two-sided document is copied onto both sides of a recording paper. A document conveyance operation of even number pages will be explained as follows in the case of small size documents.

Figure 15:
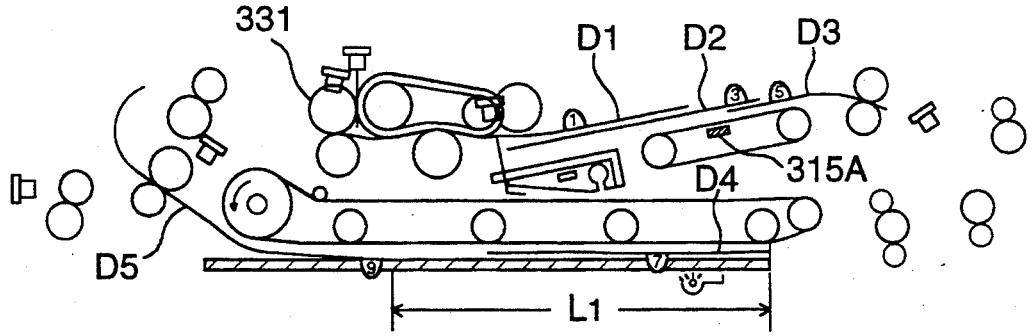
FIGS. 15A to 15G are schematic illustrations showing the first half of the document conveyance process for evennumbered pages in the R-RDH mode.
Figure 15:
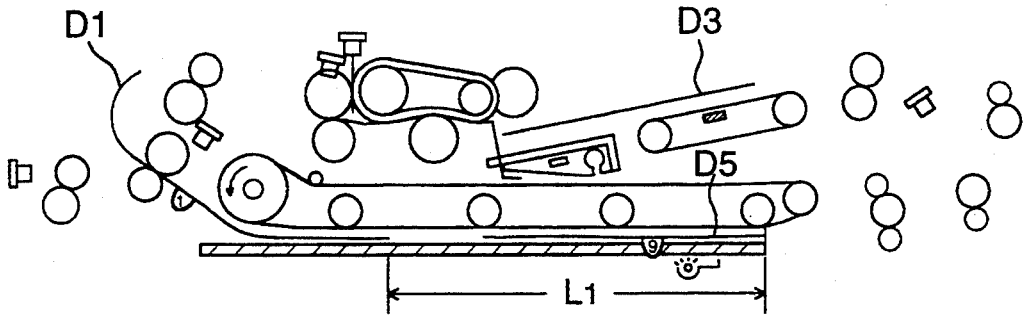
Figure 15:
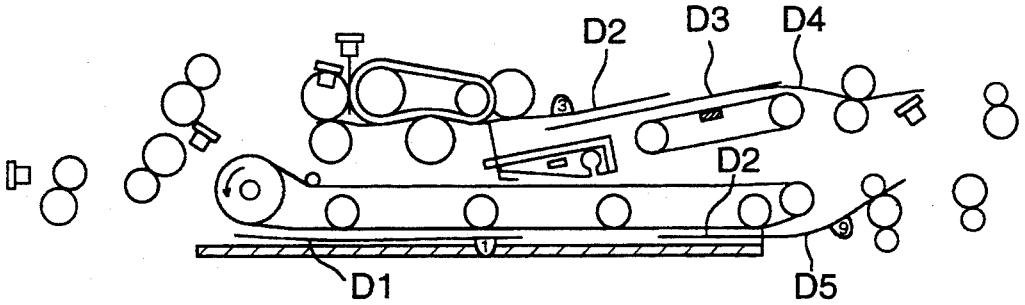
Figure 15:
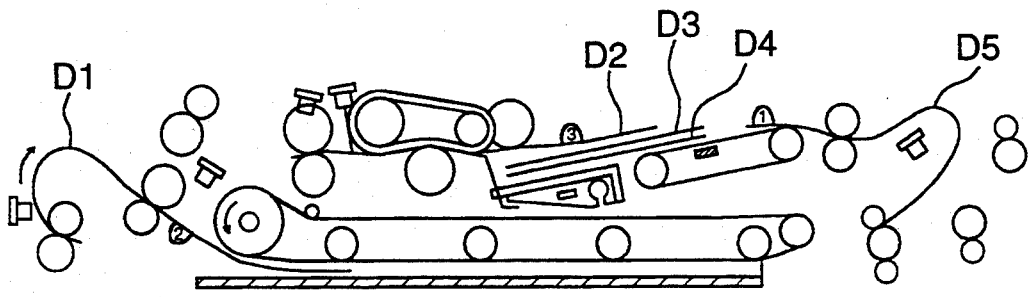
Figure 15:
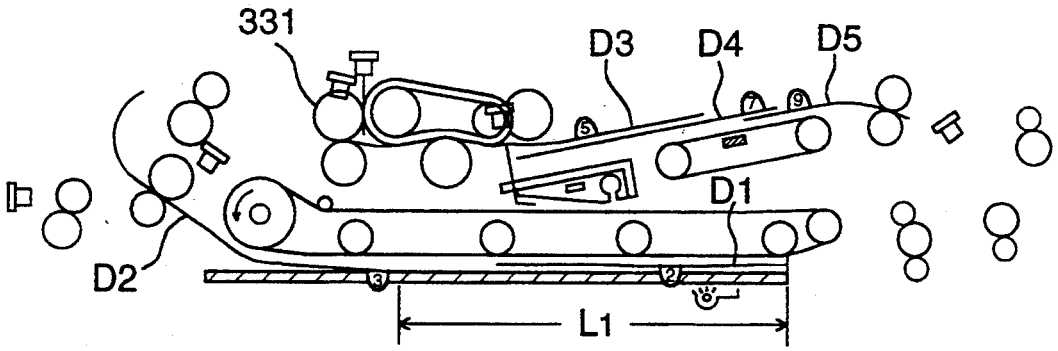
Figure 15:
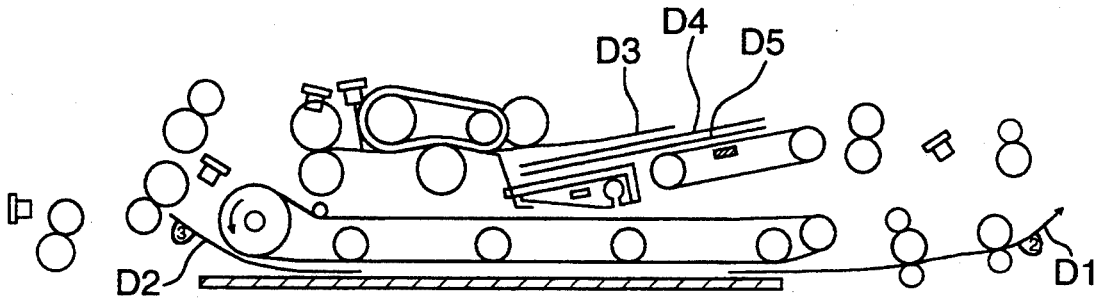
Figure 15:
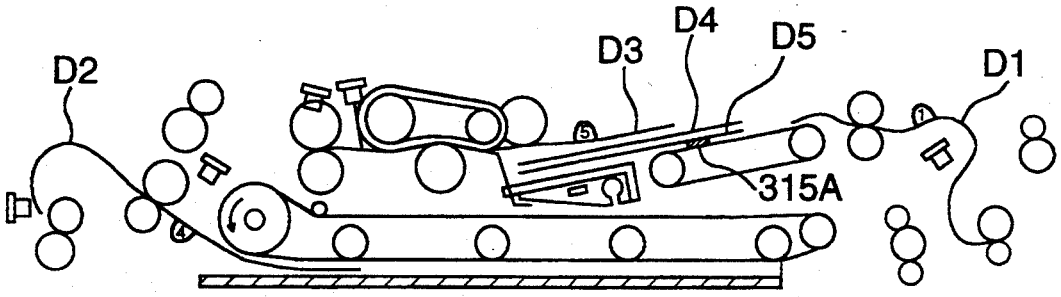

(3a) FIG. 15A shows a state of start of the leading document D1 of even number pages. At this time, the previous document D4 is stopped at a predetermined position on the platen glass 111 and exposed with light. The leading end of the document D5 is located in a waiting position that, is separate from the document D4 by a predetermined interval L1.

(3b) Next, the document D5 is conveyed to a predetermined position on the platen glass 111 and exposed with light. At the same time, the leading document D1 in the second circulation reaches one end of the platen glass 111 and stops at the position while an interval L1 is maintained between the documents D1 and D5. While the document D5 is being exposed, the document D2 is sent out, and waits for the successive operation at the position of the registration roller.

(3c) When the documents D5 and D1 are concurrently conveyed and the trailing end of the document D1 passes the registration sensor S7, the conveyance belt 341 is reversed so that the document D1 is conveyed to the reversal passage 336.

(3d) Successively, the document D1 is conveyed in the reverse direction. After the document D1 has passed through the passage i, it is reversed and advances onto the platen glass 111 while the second surface (2) is set downward. The document D5 advances to the document stack tray 310. After a predetermined period of time has passed from when the leading end of the document D1 was detected by the reversal detection sensor S17, the motor M2 is turned off and switched to a normally rotating operation. However, since the reversal roller is always rotated in a normal direction, the document D1 is successively conveyed onto the platen glass 111. Further, after a predetermined period of time has passed from when the sensor S17 was turned on, the delivery clutch CL1 is turned on, so that the documents D2 and D1 are sent out while they are kept at a predetermined distance.

(3e) The documents D1 and D2 are concurrently conveyed, and the document D1 is stopped at a predetermined position at the right end of the platen glass 111 and exposed with light. At this time, the document D2 advances to a predetermined waiting position on the platen glass 111 and stops at the position. The document D3 is sent out while the document D2 is being exposed with light, and stopped at a position where it collides with the registration roller 331.

(3f) The document D1 is discharged to the paper discharge reversal section 350. At the same time, the document D2 advances onto the platen glass 111.

(3g) The document D2 is reversed by the reversal guide plate 336, and advances to one end of the platen glass 111 under the condition that the fourth surface (4) is set downward. In the mean time, the leading document D1 passes through the reversal passages j, k, m and n in the paper discharge reversal section 350, and advances to the document stack section 310 under the condition that the first surface (1) is set upward.

In the same manner, the documents of even numbers are reversed in the intermediate conveyance section 330, and conveyed on to the platen glass 111 under the condition that the even number pages are set downward. After exposure, the documents are reversed in the paper discharge reversal section 350, and returned below the lowermost layer of the document stack on the document stack section 310 under the condition that the odd number pages are set upward.

In this connection, the feed belt having the gripper section and the movable pushing plate in the automatic document feeder of the present invention can be effectively applied to a circulation type automatic document feeder (RDH). In addition to that, the feed belt having the gripper section and the movable pushing plate of the present invention can be also applied to a sheet refeeding device in which the feeding sheet setting section and the discharging sheet stacking section are integrated into one unit.

As described above, according to the automatic document feeder of the present invention, the uppermost sheet of the documents that have been set or restacked on the document stack tray is sent and returned to the lowermost layer of the document stack on the document stack tray through the paper feeding section and processing section. Therefore, the front and rear surfaces are not rubbed, so that the documents are not stained. Further, in the automatic document feeder of the present invention, it is not necessary to provide a suction unit so that the structure can be simplified. As a result, the manufacturing cost can be reduced, and further noise and vibration can be avoided.

According to the present invention, when a wide belt having the gripper section is used, the damage caused in the leading end of a document can be prevented.

Especially, in the RDH and R-RDH modes of the automatic document feeder of the present invention, when a two-sided document sent out from the paper discharge reversal section is returned to the bottom of the document stack, the returned document can be positively and stably separated from the documents on the document stack section. Further, the copy number separation means of the present invention does not interfere with a document stacking operation to stack documents on the document stack section. Therefore, the document operation is easy.

What is claimed is:

1. An apparatus for repeatedly feeding a pile of sheets to a sheet processing section, comprising:

a sheet stand on which a pile of sheets are stacked;

sheet feeding means for feeding sheets from a top of the pile of sheets stacked on the sheet stand so that the sheets in the pile are fed one by one, to the sheet processing section;

sheet returning means for returning each sheet of the pile from the sheet processing section to the sheet stand; and an endless belt disposed between the sheet returning means and the sheet stand, said endless belt being positioned to be adjacent to a rear part of the sheet stand so that a plurality of trailing edges of the pile of sheets are loaded on said endless belt adjacent the rear part of the sheet stand, the endless belt including a holding means to hold a leading edge of a sheet being returned by said sheet returning means so that the endless belt conveys the sheet being returned to the sheet stand together with the holding means and inserts the sheet being returned to the sheet stand under the pile of sheets on the sheet stand;

the sheet stand including a stopper that comes in contact with a leading edge portion of each sheet of the pile of sheets; and wherein the sheet feeding means is disposed at a position above the top of the pile of sheets stacked on the sheet stand, and the sheet stand includes lifting means for lifting up the pile of sheets so as to bring an uppermost sheet in the pile of sheets in pressure contact with the sheet feeding means, and wherein the lifting means lowers the pile of sheets so as to allow an inserted sheet inserted under the pile of sheets to be brought in contact with the stopper.

2. The apparatus of claim 1, wherein the holding means comprises a holding member fixed to the endless belt so that the sheet being returned to the sheet stand is sandwiched between the holding member and the endless belt.

3. The apparatus of claim 2, wherein the holding member is fixed so as not to protrude above a surface of a first portion of the endless belt, the first portion of the endless belt being positioned on said endless belt to precede another portion of said endless belt which sandwiches the sheet being returned to the sheet stand between the endless belt and the holding member when viewed in a conveying direction of said endless belt.

4. The apparatus of claim 3, wherein a surface of still another portion of the endless belt that follows the another portion of the endless belt when viewed in the conveying direction of the endless belt has a high frictional coefficient.

5. The apparatus of claim 2, further comprising detection means for detecting a position of the endless belt; and control means for controlling the endless belt to stop at a position where the holding member will hold a leading edge of the sheet being returned to the sheet stand.

6. The apparatus of claim 2, wherein the endless belt conveys a sheet from said pile of sheets to the processing section at a speed higher than returning speed of the sheet returning means.

7. The apparatus of claim 1, further comprising separation means for separating the sheets inserted under said pile of sheets from sheets to be fed from the top of said pile of sheets to the sheet processing section.

8. The apparatus of claim 7, wherein the separation means comprises a separating lever member which is positioned at a side of the pile of sheets and wherein said separating lever is moved in a direction transverse to the conveying direction of the endless belt.

9. The apparatus of claim 1, wherein the endless belt is wider than a width of the pile of sheets.

10. The apparatus of claim 1, wherein the sheet returning means comprises a correction means for correcting a position of the sheet.

11. An apparatus for repeatedly feeding a pile of sheets to a sheet processing section, comprising:

a sheet stand on which a pile of sheets are stacked;

sheet feeding means for feeding sheets from a top of the pile of sheets stacked on the sheet stand so that the sheets in the pile are fed one by one to the sheet processing section;

sheet returning means for returning each sheet of the pile from the sheet processing section to the sheet stand; and an endless belt disposed between the sheet returning means and the sheet stand, said endless belt being positioned adjacent to a rear part of the sheet stand so that a plurality of trailing edges of the pile of sheets are loaded on said endless belt adjacent the rear part of the sheet stand, the endless belt including a holding means to hold a leading edge of a sheet being returned by said sheet returning means to the sheet stand so that the endless belt conveys the sheet being returned to the sheet stand together with the holding means and inserts the sheet being returned to the sheet stand under the pile of sheets on the sheet stand;

the sheet stand including a stopper that comes in contact with a leading edge portion of each sheet of the pile of sheets, and further comprising:

separation means for separating the sheets inserted under said pile of sheets from sheets to be fed from the top of said pile of sheets to the sheet processing section; wherein:

the separation means including a lever member which is movable in three steps: wherein:

at a first step the lever member is retracted from a position on the top of the pile of sheets to a first position that is beyond the edge portions of the pile of sheets;

at a second step, the lever member is brought from the first position beyond the edge portions of the pile of sheet to a second position that is below a bottom sheet of the pile of sheets; and at a third step, the lever member is urged in an upward direction from the second position so as to lift up the pile of sheets by a predetermined height.

12. An apparatus for repeatedly feeding a pile of sheets to a sheet processing section, comprising:

a sheet stand on which a pile of sheets are stacked;

sheet feeding means for feeding sheets from a top of the pile of sheets stacked on the sheet stand so that the sheets in the pile are fed, one by one, to the sheet processing section;

sheet returning means for returning each sheet of the pile from the sheet processing section to the sheet stand; and an endless belt disposed between the sheet returning means and the sheet stand, said endless belt being positioned adjacent to a rear part of the sheet stand so that a plurality of trailing edges of the pile of sheets are loaded on said endless belt adjacent the rear part of the sheet stand, the endless belt including a holding means to hold a leading edge of a sheet being returned by said sheet returning means so that the endless belt conveys the sheet being returned to said sheet stand together with the holding means and inserts the sheet being returned to the sheet stand under the pile of sheets on the sheet stand;

the sheet stand including a stopper that comes in contact with a leading edge portion of each sheet of the pile of sheets, said apparatus further comprising:

separation means for separating the sheets inserted under said pile of sheets from sheets to be fed from said pile of sheets to the sheet processing section; wherein the endless belt is provided with a cut out portion so as not to interfere with a movement of the separation means.

* * * * *